US007355112B2

(12) United States Patent
Laakso

(10) Patent No.: US 7,355,112 B2
(45) **Date of Patent: *Apr. 8, 2008**

(54) GAMING DEVICE WHICH DYNAMICALLY MODIFIES BACKGROUND MUSIC BASED ON PLAY SESSION EVENTS

(75) Inventor: Jeffrey P. Laakso, Reno, NV (US)

(73) Assignee: IGT, Reno, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/530,759

(22) Filed: Sep. 11, 2006

(65) Prior Publication Data

US 2007/0006708 A1 Jan. 11, 2007

Related U.S. Application Data

(63) Continuation of application No. 10/658,997, filed on Sep. 9, 2003, now Pat. No. 7,105,736.

(51) Int. Cl.
*G10H 1/00* (2006.01)

(52) U.S. Cl. ..... 84/615; 463/20

(58) Field of Classification Search ..... 84/615; 273/269, 143 R, 143 E; 463/35, 20, 42
See application file for complete search history.

(56) References Cited

U.S. PATENT DOCUMENTS 3,831,172 A 8/1974 Olliges et al.
4,300,225 A 11/1981 Lambl
4,314,236 A 2/1982 Mayer et al.
4,339,798 A 7/1982 Hedges et al.
4,344,345 A 8/1982 Sano
4,363,482 A 12/1982 Goldfarb
RE31,441 E 11/1983 Nutting et al.
4,496,149 A 1/1985 Schwartzberg
4,582,324 A 4/1986 Koza et al.
4,618,150 A 10/1986 Kimura
4,624,459 A 11/1986 Kaufman
4,660,107 A 4/1987 Chippendale, Jr.
4,695,053 A 9/1987 Vazquez, Jr. et al.

(Continued)

FOREIGN PATENT DOCUMENTS

EP 0 945 837 A2 9/1999

(Continued)

OTHER PUBLICATIONS

Article, "A Salute to Game Shows-The Price Is Right-Pricing Games-Three Strikes," p. 8 of 9, online, retrieved on Aug. 16, 2000. Retrieved from the Internet: <http://ben-schumin.simplenet.com/game-shows/shows/price-is-right/pricing-games-4.htm>.

(Continued)

*Primary Examiner*—Lincoln Donovan
*Assistant Examiner*—Jianchun Qin
(74) *Attorney, Agent, or Firm*—Bell, Boyd & Lloyd LLP

(57) ABSTRACT

A gaming device having a sound generating device operable to produce a background sound. The gaming device tracks play session events and determines when the tracked events meet a designated characteristic or parameter. The gaming device modifies the background sound based on whether designated tracked events occur.

68 Claims, 14 Drawing Sheets

U.S. PATENT DOCUMENTS

| | | | |
|---|---|---|---|
| 4,712,189 | A | 12/1987 | Mohri |
| 4,732,386 | A | 3/1988 | Rayfiel |
| 4,733,593 | A | 3/1988 | Rothbart |
| 4,791,558 | A | 12/1988 | Chaitin et al. |
| 4,876,937 | A | 10/1989 | Suzuki |
| 4,961,575 | A | 10/1990 | Perry |
| 4,974,483 | A | 12/1990 | Luzzatto |
| 4,974,857 | A | 12/1990 | Beall et al. |
| 5,046,735 | A | 9/1991 | Hamano et al. |
| 5,096,195 | A | 3/1992 | Gimmon |
| 5,119,465 | A | 6/1992 | Jack |
| 5,179,517 | A | 1/1993 | Sarbin et al. |
| 5,221,801 | A | 6/1993 | Bruti et al. |
| 5,223,828 | A | 6/1993 | McKiel, Jr. |
| 5,242,163 | A | 9/1993 | Fulton |
| 5,258,574 | A | 11/1993 | Kawano |
| 5,266,736 | A | 11/1993 | Saito |
| 5,275,400 | A | 1/1994 | Weingardt et al. |
| 5,287,102 | A | 2/1994 | McKiel, Jr. |
| 5,331,112 | A | 7/1994 | Sato et al. |
| 5,342,047 | A | 8/1994 | Heidel et al. |
| 5,371,345 | A | 12/1994 | LeStrange et al. |
| 5,390,938 | A | 2/1995 | Takeya |
| 5,393,061 | A | 2/1995 | Manship et al. |
| 5,393,070 | A | 2/1995 | Best |
| 5,429,507 | A | 7/1995 | Kaplan |
| 5,430,835 | A | 7/1995 | Williams et al. |
| 5,446,902 | A | 8/1995 | Islam |
| 5,449,173 | A | 9/1995 | Thomas et al. |
| 5,469,511 | A | 11/1995 | Lewis et al. |
| 5,470,233 | A | 11/1995 | Fruchterman et al. |
| 5,472,197 | A | 12/1995 | Gwiasda et al. |
| 5,508,699 | A | 4/1996 | Silverman |
| 5,515,764 | A | 5/1996 | Rosen |
| 5,577,253 | A | 11/1996 | Blickstein |
| 5,606,144 | A | 2/1997 | Dabby |
| 5,625,845 | A | 4/1997 | Allran |
| 5,668,996 | A | 9/1997 | Radinsky |
| 5,695,188 | A | 12/1997 | Ishibashi |
| 5,697,843 | A | 12/1997 | Manship et al. |
| 5,703,310 | A | 12/1997 | Kurakake et al. |
| 5,707,286 | A | 1/1998 | Carlson |
| 5,715,459 | A | 2/1998 | Celi |
| 5,745,761 | A | 4/1998 | Celi |
| 5,745,762 | A | 4/1998 | Celi |
| 5,758,875 | A | 6/1998 | Giacalone, Jr. |
| 5,762,552 | A | 6/1998 | Vuong et al. |
| 5,766,074 | A | 6/1998 | Cannon et al. |
| 5,772,509 | A | 6/1998 | Weiss |
| 5,778,231 | A | 7/1998 | Van Hoff |
| 5,792,972 | A | 8/1998 | Houston |
| 5,802,364 | A | 9/1998 | Senator |
| 5,807,172 | A | 9/1998 | Piechowiak |
| 5,809,303 | A | 9/1998 | Senator |
| 5,833,538 | A | 11/1998 | Weiss |
| 5,839,958 | A | 11/1998 | Ozarow |
| 5,848,932 | A | 12/1998 | Adams |
| 5,854,927 | A | 12/1998 | Gelissen |
| 5,876,284 | A | 3/1999 | Acres et al. |
| 5,880,386 | A | 3/1999 | Wachi et al. |
| 5,889,990 | A | 3/1999 | Coleman |
| 5,892,171 | A | 4/1999 | Ide |
| 5,902,184 | A | 5/1999 | Bennett et al. |
| 5,908,354 | A | 6/1999 | Okuniewicz |
| 5,910,048 | A | 6/1999 | Feinberg |
| 5,911,071 | A | 6/1999 | Jordan |
| 5,920,720 | A | 7/1999 | Toutonghi |
| 5,920,842 | A | 7/1999 | Cooper et al. |
| 5,923,878 | A | 7/1999 | Marsland |
| 5,923,880 | A | 7/1999 | Rose |
| 5,930,509 | A | 7/1999 | Yates |
| 5,937,193 | A | 8/1999 | Evoy |
| 5,946,487 | A | 8/1999 | Dangelo |
| 5,946,489 | A | 8/1999 | Yellin |
| 5,964,843 | A | 10/1999 | Eisler et al. |
| 5,966,535 | A | 10/1999 | Benedikt |
| 5,967,894 | A | 10/1999 | Kinoshita et al. |
| 5,970,249 | A | 10/1999 | Holze |
| 5,978,585 | A | 11/1999 | Crelier |
| 5,997,401 | A | 12/1999 | Crawford |
| 5,999,731 | A | 12/1999 | Yellin |
| 6,003,038 | A | 12/1999 | Chen |
| 6,015,346 | A | 1/2000 | Bennett |
| D421,277 | S | 2/2000 | McGahn et al. |
| 6,021,272 | A | 2/2000 | Cahill |
| 6,021,273 | A | 2/2000 | Criesemer |
| 6,026,238 | A | 2/2000 | Bond |
| 6,029,000 | A | 2/2000 | Woolsey |
| 6,031,993 | A | 2/2000 | Andrews |
| 6,035,120 | A | 3/2000 | Ravichandran |
| 6,052,527 | A | 4/2000 | Delcourt et al. |
| 6,056,642 | A | 5/2000 | Bennett |
| 6,062,979 | A | 5/2000 | Inoue |
| 6,066,181 | A | 5/2000 | DeMaster |
| 6,071,192 | A | 6/2000 | Weiss |
| 6,074,432 | A | 6/2000 | Guccione |
| 6,075,940 | A | 6/2000 | Gosling |
| 6,084,169 | A | 7/2000 | Hasegawa et al. |
| 6,089,976 | A | 7/2000 | Schneider et al. |
| 6,089,978 | A | 7/2000 | Adams |
| 6,092,147 | A | 7/2000 | Levy |
| 6,096,095 | A | 8/2000 | Halstead |
| 6,102,400 | A | 8/2000 | Scott et al. |
| 6,103,964 | A | 8/2000 | Kay |
| 6,106,393 | A | 8/2000 | Sunaga et al. |
| 6,110,041 | A | 8/2000 | Walker et al. |
| 6,110,043 | A | 8/2000 | Olsen |
| 6,110,226 | A | 8/2000 | Bothner |
| 6,113,495 | A | 9/2000 | Walker |
| 6,117,009 | A | 9/2000 | Yoseloff |
| 6,126,165 | A | 10/2000 | Sakamoto |
| 6,131,191 | A | 10/2000 | Cierniak |
| 6,138,273 | A | 10/2000 | Sturges |
| 6,141,794 | A | 10/2000 | Dice |
| 6,142,875 | A | 11/2000 | Kodachi et al. |
| 6,146,273 | A | 11/2000 | Olsen |
| 6,146,276 | A | 11/2000 | Okuniewicz |
| 6,155,925 | A | 12/2000 | Giobbi et al. |
| 6,159,097 | A | 12/2000 | Gura |
| 6,174,233 | B1 | 1/2001 | Sunaga et al. |
| 6,174,235 | B1 | 1/2001 | Walker et al. |
| 6,175,632 | B1 | 1/2001 | Marx |
| 6,198,395 | B1 | 3/2001 | Sussman |
| 6,217,448 | B1 | 4/2001 | Olsen |
| 6,233,731 | B1 | 5/2001 | Bond et al. |
| 6,238,288 | B1 | 5/2001 | Walker et al. |
| 6,241,612 | B1 | 6/2001 | Heredia |
| 6,254,481 | B1 | 7/2001 | Jaffe |
| 6,270,411 | B1 | 8/2001 | Gura et al. |
| 6,293,869 | B1 | 9/2001 | Kwan et al. |
| 6,295,638 | B1 | 9/2001 | Brown et al. |
| 6,302,790 | B1 | 10/2001 | Brossard |
| 6,306,034 | B1 | 10/2001 | Sakamoto et al. |
| 6,309,299 | B1 | 10/2001 | Weiss |
| 6,309,301 | B1 | 10/2001 | Sano |
| 6,311,982 | B1 | 11/2001 | Lebensfeld et al. |
| 6,321,323 | B1 | 11/2001 | Nugroho et al. |
| 6,328,648 | B1 | 12/2001 | Walker et al. |
| 6,390,923 | B1 | 5/2002 | Yoshitomi et al. |
| 6,409,596 | B1 | 6/2002 | Hayashida et al. |
| 6,416,411 | B1 | 7/2002 | Tsukahara |
| 6,504,089 | B1 | 1/2003 | Negishi et al. |
| 6,516,466 | B1 | 2/2003 | Jackson |
| 6,537,152 | B2 | 3/2003 | Seelig et al. |

| | | | | |
|---|---|---|---|---|
| 6,544,122 | B2 | 4/2003 | Araki et al. | |
| 6,554,703 | B1 | 4/2003 | Bussick et al. | |
| 6,561,908 | B1 | 5/2003 | Hoke | |
| 6,599,195 | B1 | 7/2003 | Araki et al. | |
| 6,638,169 | B2 | 10/2003 | Wilder et al. | |
| 6,656,046 | B1 | 12/2003 | Yoseloff et al. | |
| 6,729,618 | B1 | 5/2004 | Koenig et al. | |
| 6,739,973 | B1 | 5/2004 | Lucchesi et al. | |
| 6,769,985 | B1 | 8/2004 | Laakso et al. | |
| 6,810,517 | B2 | 10/2004 | Bond et al. | |
| 6,848,996 | B2 | 2/2005 | Hecht et al. | |
| 6,935,955 | B1 | 8/2005 | Kaminkow et al. | |
| 6,942,574 | B1 | 9/2005 | LeMay et al. | |
| 7,105,736 | B2 | 9/2006 | Laakso | |
| 2001/0029542 | A1 | 10/2001 | Nishimura | |
| 2002/0077165 | A1 | 6/2002 | Bansemer et al. | |
| 2002/0090990 | A1 | 7/2002 | Joshi et al. | |
| 2002/0109718 | A1 | 8/2002 | Mansour et al. | |
| 2003/0064798 | A1 | 4/2003 | Grauzer et al. | |
| 2003/0064808 | A1 | 4/2003 | Hecht et al. | |
| 2003/0073489 | A1* | 4/2003 | Hecht et al. | 463/35 |
| 2003/0073490 | A1 | 4/2003 | Hecht et al. | |
| 2003/0073491 | A1* | 4/2003 | Hecht et al. | 463/35 |
| 2004/0053695 | A1* | 3/2004 | Mattice et al. | 463/42 |
| 2004/0063489 | A1* | 4/2004 | Crumby | 463/20 |
| 2004/0142739 | A1 | 7/2004 | Loose et al. | |
| 2004/0142747 | A1 | 7/2004 | Pryzby | |
| 2004/0198489 | A1 | 10/2004 | Kaminkow | |
| 2004/0209685 | A1* | 10/2004 | Lucchesi et al. | 463/35 |
| 2004/0242307 | A1 | 12/2004 | Laakso | |
| 2005/0043090 | A1* | 2/2005 | Pryzby et al. | 463/35 |
| 2005/0054440 | A1 | 3/2005 | Anderson et al. | |
| 2005/0054441 | A1 | 3/2005 | Landrum | |
| 2005/0054442 | A1 | 3/2005 | Anderson et al. | |
| 2005/0064935 | A1 | 3/2005 | Blanco | |
| 2005/0071023 | A1 | 3/2005 | Gilliland | |
| 2005/0096121 | A1 | 5/2005 | Gilliland | |
| 2005/0277469 | A1 | 12/2005 | Pryzby et al. | |
| 2005/0282631 | A1 | 12/2005 | Bonney et al. | |
| 2006/0073881 | A1 | 4/2006 | Pryzby et al. | |
| 2007/0006708 | A1 | 1/2007 | Laakso | |

FOREIGN PATENT DOCUMENTS

| | | | |
|---|---|---|---|
| EP | 0 978 809 | A2 | 2/2000 |
| EP | 0 997 856 | A2 | 5/2000 |
| EP | 0 997 857 | A2 | 5/2000 |
| EP | 1 079 345 | A1 | 2/2001 |
| EP | 1 225 565 | A2 | 7/2002 |
| EP | 1439507 | A3 | 3/2005 |
| GB | 2 201 279 | A | 8/1988 |
| JP | 11197292 | A | 12/1997 |
| JP | 11216221 | A | 8/1999 |
| JP | 2000107466 | A | 4/2000 |
| JP | 02000296209 | A | 10/2000 |
| JP | 2001062029 | A * | 3/2001 |
| JP | 2003290422 | A | 10/2003 |
| WO | WO 2004025583 | A2 | 3/2004 |
| WO | WO 2005/026883 | A2 | 3/2005 |
| WO | WO 2005/027059 | A2 | 3/2005 |
| WO | WO 2005026894 | A2 | 3/2005 |
| WO | WO 2005113089 | A1 | 12/2005 |
| WO | WO 2005113091 | A1 | 12/2005 |
| WO | WO 2005114598 | A1 | 12/2005 |
| WO | WO 2005117647 | A1 | 12/2005 |
| WO | WO 2005120127 | A1 | 12/2005 |
| WO | WO 2006017036 | A1 | 2/2006 |
| WO | WO 2006017445 | A2 | 2/2006 |

OTHER PUBLICATIONS

Article, "Frankie & Annette's Beach Party Bally Gaming," published by Strictly Slots, Dec. 2001.

Article, "Megaman X's Soundcard History Museum," pp. 1-5, retrieved on May 11, 2000 on Internet at http://digitalparadise.cgocable.ca/MegaMan_X/Soundcards.

Article, "Microprocessor Report," pp. 2, 12-17, published by Micro Design Resources on Mar. 25, 1996.

Article, "Monopoly Movers & Shakers Williams/WMS Gaming," published by Strictly Slots publication in Jul. 2000.

Brochure of Bally Gaming, Inc., "EVO HYBRID Frankie & Annette's Beach Party," published by Bally Gaming, Inc. in the year 2001 on or before December thereof.

Brochure of Bally Gaming, Inc., "Frankie & Annette's Beach Party (EVO Hybrid)," http://www.ballygaming.com/gameroom/games.asp?gameID=664, Jan. 9, 2004.

Brochure of IGT, "Elephant King," http://www.igt.com/games/new_games/elephant.html, Mar. 21, 2001.

Brochure of IGT, "Leopard Spots, Double Diamond 2000, Little Green Men, Elephant King, I Dream of Jeannie," available in Oct. 1999.

Brochure of IGT, "Run for Your Money S-Plus Limited," published in the year 1998 on or before December thereof.

Brochure of IGT, "Top Dollar S-Plus Limited," published in the year 1998 on or before December thereof.

Brochure of IGT, "Totem Pole," written by IGT, available in the year 1997, on or before December thereof.

Brochure of IGT, "Wheel of Fortune," published in the year 1998 on or before December thereof.

Brochure of WMS Gaming Inc., "Meet the Next Generation of Monopoly Slot Machines from WMS Gaming?" published by Hasbro, Inc. in the year 1999 on or before December thereof.

Brochure of WMS Gaming Inc., "Monopoly Chairman of the Board," published by Hasbro, Inc. in the year 1999 on or before December thereof.

Brochure of WMS Gaming Inc., "Monopoly Once Around," published by Hasbro, Inc. in the year 1998 on or before December thereof.

Brochure of WMS Gaming Inc., "Monopoly Reel Estate," published by Hasbro, Inc. in the year 1998 on or before December thereof.

Brochure of WMS Gaming Inc., "Movers & Shakers," published by Hasbro, Inc. in the year 2000 on or before December thereof.

Chutes and Ladders CD-ROM Game, Hasbro Interactive, Inc., available in the year 1999 on or before December thereof.

Description of Accelerated Credit Roll-Up in Gaming Machines written by IGT, available in the year 1999 on or before December thereof.

Description of Action Prompts in Gaming Machines, written by IGT, available in the year 1999 on or before December thereof.

Description of Last Sound in Credit Roll-Up in Gaming Machines written by IGT, available in the year 2000 on or before December thereof.

Description of Lighting Features in Gaming Machines, written by IGT, available in the year 1999 on or before December thereof.

Description of Maximum Wager Sound and Bet Sounds in Gaming Devices written by IGT, available in the year 2000 on or before December thereof.

Description of Maximum Wager Sound and Bet Sounds in Gaming Devices written by IGT, available in the year 2000 on or before December thereof.

Description of Payout Sound Feature in Gaming Machine written by IGT, available in the year 1999 on or before December thereof.

Description of Progressive Sound Feature in Pinball and Video Games written by IGT, available in the year 1999 on or before December thereof.

Description of Sound Effects in Gaming Devices written by IGT, available in the year 2000 on or before December thereof.

Description of Sound Feature in Totem Pole™ Gaming Machine written by IGT, available in the year 1997 on or before December thereof.

Description of Tempo Change In Gaming Machines written by IGT, available in the year 2000 on or before December thereof.

Description of Verbal Wager Feature in "Dick Clark" Gaming Machine written by IGT, available in the year 2000 on or before December thereof.

Description of Volume Control Functions in Gaming Machines written by IGT, available in the year 1999 on or before December thereof.

Definition of Pitch, Merriam-Webster's Collegiate Dictionary, Tenth Edition, p. 886, 1999, on or before December thereof.

MIDI Media Adaptation Layer for IEEE-1394, published by the Association of Musical Electronics Industry in Tokyo, Japan and The MIDI Manufacturers Association in Los Angeles, California, Nov. 30, 2000, pp. 1-17.

Press Release by Ian Fried of CNET News.com, "Microsoft Releases XP for Slot Machines," file://C:WINDOW...\Microsoft releases XP for slot machines—Tech News—CNET.com.htm., Nov. 28, 2001, pp. 1-2.

Press Release, "WMS Gaming's Monopoly Slot Machines Named 1998's Most Innovative Gaming Product At The American Gaming, Lodging and Leisure Summit," published by WMS Gaming Inc. on Jan. 13, 1999.

Screen Shot and Description by IGT of "Free Spins Bonus (Elephant King)" written by IGT, available in Oct. 1999.

Screen Shots of "Race Car Bonus Feature" written by IGT, available in the year 1998 on or before December thereof.

The Java™ Tutorial, "What Can Java Technology Do?" http://java.sun.com/docs/books/tutorial/getStarted/i.../definition.htm, Oct. 16, 2000, pp. 1-2.

The MIDI File Format, http://crystal.capana.org.au/ghansper/midi_introduction/midi_file_format.html, Dec. 28, 2001, pp. 1-10.

Tutorial on MIDI and Music Synthesis MIDI Manufacturers Association, 1995-2001 [online] [printed on Mar. 13, 2007] available on or before Dec. 2001. Retrieved from the Internet at <URL:www.midi.org/about-midi/tutorial/tutor.shtml>.

* cited by examiner

FIG. 4

| | EXAMPLE ACTIVITY PACE DATA | |
|---|---|---|
| | Quantity of Activities / Minute | Pace Identifier |
| 168 | 1 Bet / Minute | P1 ~ 194 |
| 170 | 2 Bets / Minute | P2 ~ 196 |
| 172 | 3 Bets / Minute | P3 ~ 198 |
| 174 | 4 Bets / Minute | P4 ~ 200 |
| 176 | 1 Win / Minute | P5 ~ 202 |
| 178 | 2 Wins / Minute | P6 ~ 204 |
| 180 | 3 Wins / Minute | P7 ~ 206 |
| 182 | 4 Wins / Minute | P8 ~ 208 |
| 184 | 1 Loss / Minute | P9 ~ 210 |
| 188 | 2 Losses / Minute | P10 ~ 212 |
| 190 | 3 Losses / Minute | P11 ~ 214 |
| 192 | 4 Losses / Minute | P12 ~ 216 |
| | • • • • • • | • • • • • • |
| | • • • • • • | • • • • • • |
| | • • • • • • | • • • • • • |

FIG. 5

| | EXAMPLE ACTIVITY PACE DATA | |
|---|---|---|
| | Type of Activity | Activity Type Identifier |
| 230 | Decision Making Game Phase | T1 ~ 252 |
| 232 | Bonus Game Entry Game Phase | T2 ~ 254 |
| 234 | Bet Level of 100 Value | T3 ~ 256 |
| 236 | Bet Level of 200 Value | T4 ~ 258 |
| 238 | Bet Level of 300 Value | T5 ~ 260 |
| 240 | Success Level of Loss of Opportunity | T6 ~ 262 |
| 242 | Success Level of Gain of Opportunity | T7 ~ 264 |
| 244 | Success Level of 0 Value | T8 ~ 266 |
| 246 | Success Level of 100 Value | T9 ~ 268 |
| 248 | Success Level of 200 Value | T10 ~ 270 |
| 250 | Success Level of 300 Value | T11 ~ 272 |
| | • • • • • • | • • • • • • |
| | • • • • • • | • • • • • • |
| | • • • • • • | • • • • • • |

FIG. 7

| EXAMPLE USE OF BACKGROUND MUSIC SYSTEM | | |
|---|---|---|
| PLAY SESSION SIMULATION OR PLAY SESSION EVENT | MOOD TYPE OR AMBIANCE TYPE | SOUND RECORDING |
| Win 282 | Victory 286 | Victory Sound Recording (Example: Fast Tempo Musical Piece with Brass Instruments) 284 |
| Loss 288 | Disappointment and Motivation 292 | Motivation Sound Recording (Example: Musical Piece Starting with Slow Tempo and Changing to Faster Tempo which is Motivational and Inspiring) 290 |
| High Betting Pace 294 | High Excitement 298 | Excitement Sound Recording (Example: Fast Tempo Musical Piece with Deep Bass which is Very Exciting) 296 |
| Low Betting Pace 300 | Low Excitement and Motivation 304 | Motivation Sound Recording (Example: Musical Piece Starting with Slow Tempo and Changing to Faster Tempo which is Motivational and Inspiring) 302 |
| High Winning Pace 305 | High Excitement 308 | Excitement Sound Recording (Example: Fast Tempo Musical Piece with Deep Bass which is Very Exciting) 306 |
| Low Winning Pace 310 | Low Excitement and Motivation 314 | Motivation Sound Recording (Example: Musical Piece Starting with Slow Tempo and Changing to Faster Tempo which is Motivational and Inspiring) 312 |
| High Success Level 316 | High Excitement 320 | Excitement Sound Recording (Example: Fast Tempo Musical Piece with Deep Bass which is Very Exciting) 318 |
| Low Success Level 322 | Low Excitement and Motivation 326 | Motivation Sound Recording (Example: Musical Piece Starting with Slow Tempo and Changing to Faster Tempo which is Motivational and Inspiring) 324 |
| Decision Making Game Phase 320 | Inner thought and Contemplation 332 | Mystery Sound Recording (Example: Soft Musical Piece which Gradually Builds and Becomes More Urgent Until the Drop-Off Releases) 330 |

GAMING DEVICE WHICH DYNAMICALLY MODIFIES BACKGROUND MUSIC BASED ON PLAY SESSION EVENTS

PRIORITY CLAIM

This application is a continuation of, and claims the benefit of, U.S. application Ser. No. 10/658,997, filed Sep. 9, 2003, the entire contents of which are hereby incorporated herein by reference.

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND OF THE INVENTION

Gaming devices are known to have sound systems which produce sound effects for a game such as a primary wagering game (e.g., slot, poker, keno) or a secondary game. These sound effects can draw the player's attention to certain events which occur during the game. For example, a sound effect can indicate a win, a loss or a bonus event while the player is playing the game.

Gaming device players can be involved in an array of bet decisions, betting patterns and paces, game states, game play variables and other gaming situations. These gaming situations can evoke different emotions, moods and levels of excitement in the player.

One of the disadvantages of the known gaming devices is that their sound systems provide a relatively low level of entertainment and excitement for the player. These sound systems are not known to produce background music (sometimes referred to herein by the acronym "BGM") to accompany the sound effects for increased entertainment and excitement. Furthermore, these known sound systems do not produce background music which adjusts or aligns itself to the different types of gaming situations experienced by the player.

Therefore, there is a need to overcome the disadvantages described above.

SUMMARY OF THE INVENTION

The present invention relates in general to a gaming device, and more particularly to a gaming device having a system for dynamically aligning background music with the play session events. The play session can be part or all of the period of time between the player's initial funding of the gaming device and the moment when the player cashes-out and leaves the gaming device. It should therefore be understood that a play session can encompass the time during which the player plays one game or a series of games, the time between game plays and the time during which the player is not playing a game, where the gaming device is idle, inactive or in a standby mode. In one embodiment of the present invention, the gaming device includes a background music system which includes a computer program which dynamically monitors or tracks the player's play session history by checking one or more sequences, series or chains of events. These events can occur during a play session when the player plays a single game (i.e., the primary wagering game) on one occasion, during a play session when the player plays the same game (i.e., the primary wagering game) multiple times or on multiple occasions, during a play session when the player plays a series of different games (i.e., different primary wagering games or primary and secondary games or during any other part of the play session). Based on the current reading of the play session history, the background sound system of the gaming device of the present invention automatically makes changes in the background music during the play session to increase player entertainment, enjoyment and interest.

Accordingly, in one embodiment, the gaming device dynamically composes and plays background music based on the activities or habits of the player or outcomes provided to the player during the play session. For example, if the player is making bets at a relatively rapid rate on sequentially played primary wagering games, the gaming device can automatically and rapidly increase the tempo of the background music to make the game more exciting. If the player is making bets at a relatively slow rate on sequentially played primary wagering games, the gaming device, in another example, automatically and gradually increases the tempo of the background music to better entertain the player.

Using the background sound system, the gaming device processor can adjust the background music when other play session events occur. For example, if the player accumulates a certain level of credits during a play session, the gaming device can automatically change the background music to have a victory-type mood or ambiance. In another example, if the player reaches a point in the play session where the player must make a decision, such as choosing an award-winning symbol from a pool of symbols, the gaming device can automatically change the mood of the background music to a mystery-type mood or ambiance.

In one embodiment, the gaming device includes: (a) a game which the player can play on multiple occasions in order to make multiple bets at a desired betting pace; (b) information which relates designated betting paces to a chain of different musical pieces; (c) one or more speakers (or other suitable devices which are meant to be included in the use of the term speakers herein) which produce background music during the plays of the game; and (c) at least one computer program. The processor executes the program instructions to dynamically track the player's betting pace in real time and to determine when the player's actual betting pace matches one of the designated betting paces. The processor executes the program in order to use such information to select one of the musical pieces associated with the designated betting pace determined by the processor. Finally, the program instructs the processor to cause the speaker to produce the selected musical piece as part of the background music. In one embodiment, the processor operates in conjunction with a sound card to cause the speaker(s) to produce the background music.

In other embodiments, the processor uses the background music system to switch musical pieces based on the quantity of outcomes per unit time which the player reaches, the success level reached by the player, the bet level set by the player, the types of decisions faced by the player or any game event encountered by the player during the play session.

In one embodiment, the gaming device makes these musical changes by stopping the play of one musical piece and starting the play of a different musical piece. In this embodiment, the gaming device stores a chain or list of different musical pieces, and the gaming device produces the musical changes by sequentially moving from piece to piece in the chain or along the list. This can include moving backwards in the chain or list. In this case, the gaming device can transition from one musical piece to another by overlapping the pieces, fading the pieces or temporarily playing a cover-up transition piece to mask off-beat transitions. It should be appreciated, however, that the background sound system can include a suitable sound editor program which is executed by the processor to automatically make these musical changes to a single musical piece.

The present invention, in one embodiment, includes a gaming device with a background music system which continuously or periodically monitors and tracks the player's play history during a play session to dynamically compose the background music. The background music system causes the background music to automatically adjust and/or align itself to the differing game events encountered by the player during a play session. The self-aligning background music can play anytime during a play session (including, but not limited to, game play time and the idle or standby time in between game plays), and when the background music is in attract mode. In an alternative embodiment, the background music of the present invention can also be played when the gaming machine is in an idle or attract mode. This type of gaming device enhances the enjoyment and entertainment experienced by players.

It is therefore an object of the present invention to provide a gaming device having a background sound system for dynamically aligning background music with play session events.

Another advantage of the present invention is to increase a player's interest and entertainment when playing gaming devices.

Yet another advantage of the present invention is to provide a gaming device with background music which automatically aligns itself to the different moods or ambiances of the game situations encountered by a player.

Still another advantage of the present invention is to reduce the predictability of a gaming device's audio output to a player.

Additional features and advantages are described herein, and will be apparent from, the following Detailed Description and the figures.

BRIEF DESCRIPTION OF THE FIGURES

FIG. 4 is a table showing example activity pace data in the background sound system of the gaming device of one embodiment of the present invention.

FIG. 5 is a table showing example activity type data in the background sound system of the gaming device of one embodiment of the present invention.

FIG. 7 is a table showing an example use of the background music system of the gaming device of one embodiment of the present invention.

DETAILED DESCRIPTION OF THE INVENTION

General

Figure 1A:
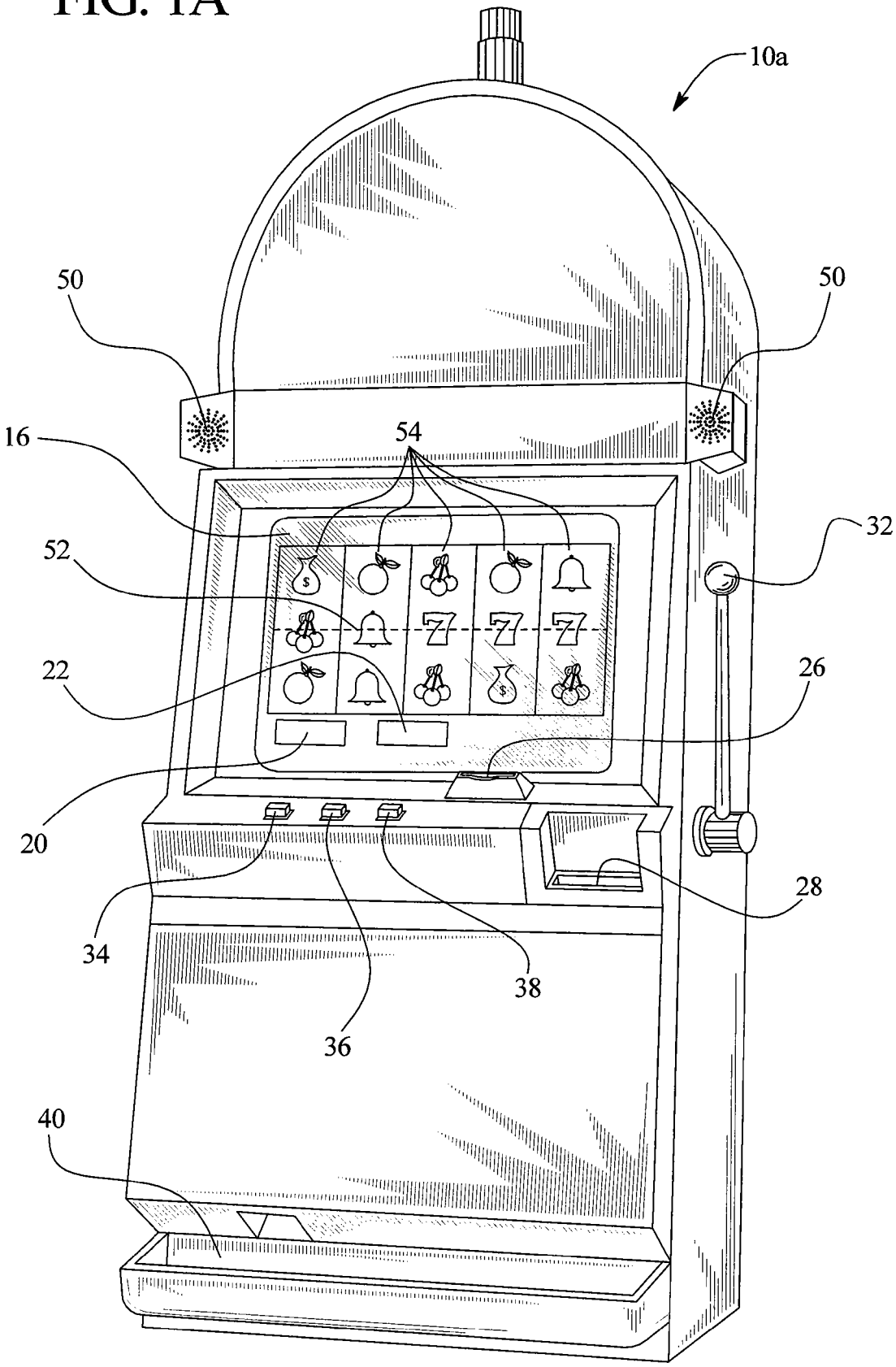
FIG. 1A is a front-side perspective view of one embodiment of the gaming device of the present invention.
Figure 1B:
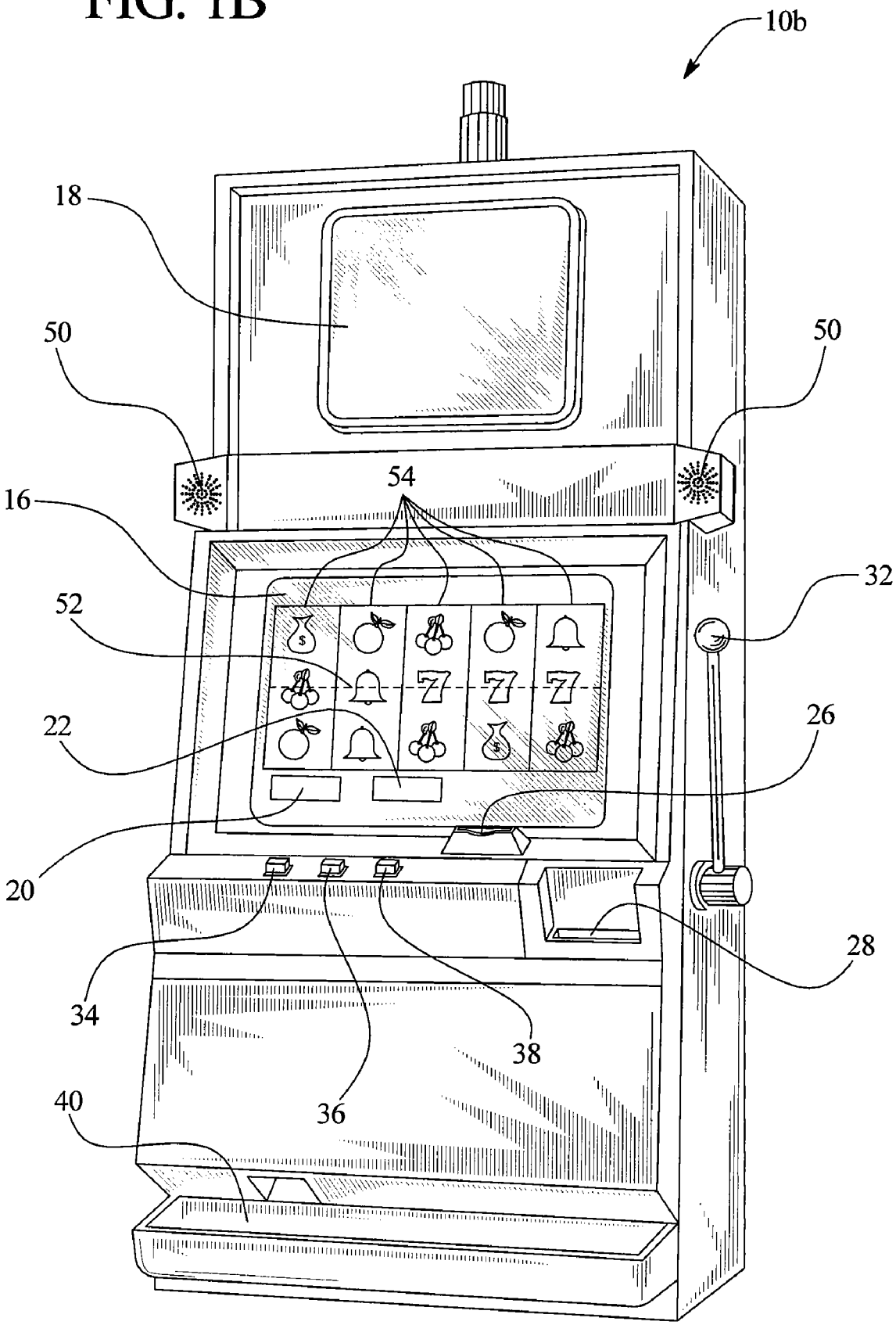
FIG. 1B is a front-side perspective view of another embodiment of the gaming device of the present invention.

Referring now to the drawings, two alternative embodiments of the gaming device of the present invention are illustrated in FIGS. 1A and 1B as gaming device 10*a* and gaming device 10*b*, respectively. Gaming device 10*a* and/or gaming device 10*b* are generally referred to herein as gaming device 10.

In one embodiment, as illustrated in FIGS. 1A and 1B, gaming device 10 has a support structure, housing or cabinet which provides support for a plurality of displays, inputs, controls and other features of a conventional gaming machine. It is configured so that a player can operate it while standing or sitting. The gaming device may be positioned on a base or stand or can be configured as a pub-style table-top game (not shown) which a player can operate preferably while sitting. As illustrated by the different configurations shown in FIGS. 1A and 1B, the gaming device can be constructed with varying cabinet and display configurations.

Figure 2A:
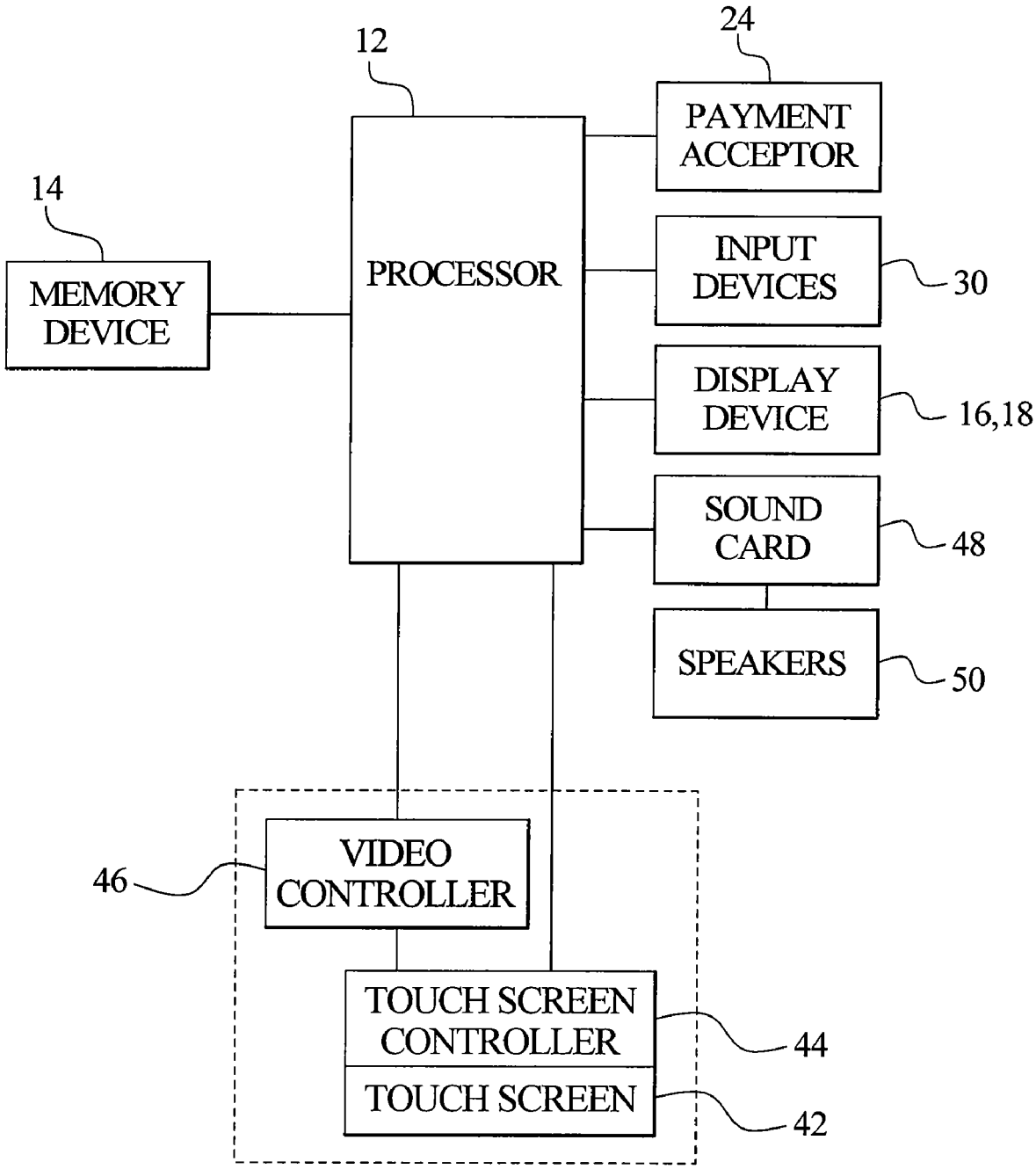
FIG. 2A is a schematic block diagram of the electronic configuration of one embodiment of the gaming device of the present invention.

In one embodiment, as illustrated in FIG. 2A, the gaming device preferably includes at least one processor 12, such as a microprocessor, a microcontroller-based platform, a suitable integrated circuit or one or more application-specific integrated circuits (ASIC's). The processor is in communication with or operable to access or to exchange signals with at least one data storage or memory device 14. In one embodiment, the processor and the memory device reside within the cabinet of the gaming device. The memory device stores program code and instructions, executable by the processor, to control the gaming device. The memory device also stores other data such as image data, event data, player input data, random or pseudo-random number generators, pay-table data or other operating data, information and applicable game rules that relate to the play of the gaming device. In another embodiment, the memory device includes random access memory (RAM). In one embodiment, the memory device includes read only memory (ROM). In a further embodiment, the memory device includes flash memory and/or EEPROM (electrically erasable programmable read only memory). Any other suitable magnetic, optical and/or semiconductor memory may be implemented in conjunction with the gaming device of the present invention. In one embodiment, the memory device 10, includes the background music system described below and illustrated in FIG. 3. In another embodiment the memory device 10 includes the primary sound file or audible event indicator file described below and illustrated in FIG. 6A.

In one embodiment, part or all of the program code and/or operating data described above can be stored in a detachable or removable memory device, including, but not limited to, a suitable cartridge, disk or CD ROM. A player can use such a removable memory device in a desktop, a laptop personal computer, a personal digital assistant (PDA) or other computerized platform. The processor and memory device may be collectively referred to herein as a "computer" or "controller."

In one embodiment, as discussed in more detail below, the gaming device randomly generates awards and/or other game outcomes based on probability data. That is, each award or other game outcome is associated with a probability and the gaming device generates the award or other game outcome to be provided to the player based on the associated probabilities. In this embodiment, since the gaming device generates outcomes randomly or based upon a probability calculation, there is no certainty that the gaming device will provide the player with any specific award or other game outcome.

In another embodiment, as discussed in more detail below, the gaming device employs a predetermined or finite set or pool of awards or other game outcomes. In this embodiment, as each award or other game outcome is provided to the player, the gaming device removes the provided award or other game outcome from the predetermined set or pool. Once removed from the set or pool, the specific provided award or other game outcome cannot be provided to the player again. In this type of embodiment, the gaming device provides players with all of the available awards or other game outcomes over the course of the play cycle and guarantees a designated amount of actual wins and losses.

In one embodiment, as illustrated in FIG. 2A, the gaming device includes one or more display devices controlled by the processor. The display devices are preferably connected to or mounted to the cabinet of the gaming device. The embodiment shown in FIG. 1A includes a central display device 16 which displays a primary game. This display device may also display any suitable secondary game associated with the primary game as well as information relating to the primary or secondary game. The alternative embodiment shown in FIG. 1B includes a central display device 16 and an upper display device 18. The upper display device may display the primary game, any suitable secondary game associated with the primary game and/or information relating to the primary or secondary game. As seen in FIGS. 1A and 1B, in one embodiment, the gaming device includes a credit display 20 which displays a player's current number of credits, cash, account balance or the equivalent. In one embodiment, the gaming device includes a bet display 22 which displays a player's amount wagered.

The display devices may include, without limitation, a monitor, a television display, a plasma display, a liquid crystal display (LCD), a display based on light emitting diodes (LED) or any other suitable electronic device or display mechanism. In one embodiment, as described in more detail below, the display device includes a touch-screen with an associated touch-screen controller. The display devices may be of any suitable configuration, such as a square, a rectangle or an elongated rectangle.

The display devices of the gaming device are configured to display at least one and preferably a plurality of games or other suitable images, symbols and indicia such as any visual representation or exhibition of the movement of objects such as mechanical, virtual or video reels and wheels, dynamic lighting, video images and images of people, characters, places, things and faces of cards, tournament advertisements, promotions and the like.

In one alternative embodiment, the symbols, images and indicia displayed on or by the display device may be in mechanical form. That is, the display device may include any suitable electromechanical device which preferable moves one or more mechanical objects, such as one or more mechanical rotatable wheels, reels or dice, configured to display at least one and preferably a plurality of games or other suitable images, symbols or indicia.

As illustrated in FIG. 2A, in one embodiment, the gaming device includes at least one payment acceptor 24 in communication with the processor. As seen in FIGS. 1A and 1B, the payment acceptor may include a coin slot 26 and a payment, note or bill acceptor 28, where the player inserts money, coins or tokens. The player can place coins in the coin slot or paper money, ticket or voucher into the payment, note or bill acceptor. In other embodiments, devices such as readers or validators for credit cards, debit cards, data cards or credit slips could be used for accepting payment. In one embodiment, a player may insert an identification card into a card reader of the gaming device. In one embodiment, the identification card is a smart card having a programmed microchip or a magnetic strip coded with a player's identification, credit totals and other relevant information. In one embodiment, money may be transferred to a gaming device through electronic funds transfer. When a player funds the gaming device, the processor determines the amount of funds entered and the corresponding amount is shown on the credit or other suitable display as described above.

As seen in FIGS. 1A, 1B and 2A, in one embodiment the gaming device includes at least one and preferably a plurality of input devices 30 in communication with the processor. The input devices can include any suitable device which enables the player to produce an input signal which is read by the processor. In one embodiment, after appropriate funding of the gaming device, the input device is a game activation device, such as a pull arm 32 or a play button 34 which is used by the player to start any primary game or sequence of events in the gaming device. The play button can be any suitable play activator such as a bet one button, a max bet button or a repeat the bet button. In one embodiment, upon appropriate funding, the gaming device begins the game play automatically. In another embodiment, upon the player engaging one of the play buttons, the gaming device automatically activates game play.

In one embodiment, as shown in FIGS. 1A and 1B, one input device is a bet one button 36. The player places a bet by pushing the bet one button. The player can increase the bet by one credit each time the player pushes the bet one button. When the player pushes the bet one button, the number of credits shown in the credit display preferably decreases by one, and the number of credits shown in the bet display preferably increases by one. In another embodiment, one input device is a bet max button (not shown) which enables the player to bet the maximum wager permitted for a game associated with the gaming device.

In one embodiment, one input device is a cash out button 38. The player may push the cash out button and cash out to receive a cash payment or other suitable form of payment corresponding to the number of remaining credits. In one embodiment, when the player cashes out, the player receives the coins or tokens in a coin payout tray 40. In one embodiment, when the player cashes out, the player may receive other payout mechanisms such as tickets or credit slips which are redeemable by a cashier or funded to the player's electronically recordable identification card.

In one embodiment, as mentioned above and seen in FIG. 2A, one input device is a touch-screen 42 coupled with a touch-screen controller 44, or some other touch-sensitive display overlay to allow for player interaction with the images on the display. The touch-screen and the touch-screen controller are connected to a video controller 46. A player can make decisions and input signals into the gaming device by touching the touch-screen at the appropriate places.

The gaming device may further include a plurality of communication ports for enabling communication of the processor with external peripherals, such as external video sources, expansion buses, game or other displays, an SCSI port or a key pad.

In one embodiment, as seen in FIG. 2A, the gaming device includes a sound generating device controlled by one or more sounds cards 48 which function in conjunction with the processor. In one embodiment, the sound generating device includes at least one and preferably a plurality of speakers 50 or other sound generating hardware and/or software for generating sounds, such as playing music for the primary and/or secondary game or for other modes of the gaming device, such as an attract mode. In one embodiment described below, the sound generating device is used to play, produce, generate or output BGM or background sound as well as primary sounds or audible event indicators. In one embodiment, the gaming device provides dynamic sounds coupled with attractive multimedia images displayed on one or more of the display devices to provide an audio-visual representation or to otherwise display full-motion video with sound to attract players to the gaming device. During idle periods, the gaming device may display a sequence of audio and/or visual attraction messages to attract potential players to the gaming device. The videos may also be customized for or to provide any appropriate information.

In one embodiment, the gaming machine may include a player or other sensor, such as a camera in communication with the processor (and possibly controlled by the processor) that is selectively positioned to acquire an image of a player actively using the gaming device and/or the surrounding area of the gaming device. In one embodiment, the camera may be configured to selectively acquire still or moving (e.g., video) images and may be configured to acquire the images in either an analog, digital or other suitable format. The display device may be configured to display the image acquired by the camera as well as display the visible manifestation of the game in split screen or picture-in-picture fashion. For example, the camera may acquire an image of the player and that image can be incorporated into the primary and/or secondary game as a game image, symbol or indicia.

The gaming device can incorporate any suitable wagering primary or base game. The gaming machine or device of the present invention may include some or all of the features of conventional gaming machines or devices. The primary or base game may comprise any suitable reel-type game, card game, number game or other game of chance susceptible to representation in an electronic or electromechanical form which produces a random outcome based on probability data upon activation of the game from a wager made by the player. That is, different primary wagering games, such as video poker games, video blackjack games, video keno, video bingo or any other suitable primary or base game may be implemented into the present invention.

In one embodiment, as illustrated in FIGS. 1A and 1B, a base or primary game may be a slot game with one or more paylines 52. The paylines may be horizontal, vertical, circular, diagonal, angled or any combination thereof. In this embodiment, the gaming device displays at least one reel and preferably a plurality of reels 54, such as three to five reels, in either electromechanical form with mechanical rotating reels or in video form with simulated reels and movement thereof. In one embodiment, an electromechanical slot machine includes a plurality of adjacent, rotatable wheels which may be combined and operably coupled with an electronic display of any suitable type. In another embodiment, if the reels are in video form, the plurality of simulated video reels are displayed on one or more of the display devices as described above. Each reel displays a plurality of indicia such as bells, hearts, fruits, numbers, letters, bars or other images which preferably correspond to a theme associated with the gaming device. In this embodiment, the gaming device awards prizes when the reels of the primary game stop spinning if specified types and/or configurations of indicia or symbols occur on an active pay line or otherwise occur in a winning combination or pattern.

In one embodiment, a base or primary game may be a poker game wherein the gaming device enables the player to play a conventional game of video poker and initially deals five cards, all face up, from a virtual deck of fifty-two cards. Cards may be dealt as in a traditional game of cards or in the case of the gaming device, the cards may be randomly selected from a predetermined number of cards. If the player wishes to draw, the player selects the cards to hold by using one or more input devices, such as pressing related hold buttons or touching a corresponding area on a touch-screen. After the player presses the deal button, the processor of the gaming device removes the unwanted or discarded cards from the display and deals replacement cards from the remaining cards in the deck. This results in a final five-card hand. The processor of the gaming device compares the final five-card hand to a payout table which utilizes conventional poker hand rankings to determine the winning hands. Award based on a winning hand and the credits wagered is provided to the player.

In another embodiment, the base or primary game may be a multi-hand version of video poker. In this embodiment, the player is dealt at least two hands of cards. In one such embodiment, the cards in all of the dealt hands are the same cards. In one embodiment each hand of cards is associated with its own deck of cards. The player chooses the cards to hold in a primary hand. The held cards in the primary hand are also held in the other hands of cards. The remaining non-held cards are removed from each displayed hand and replaced with randomly dealt cards. Since the replacement cards are randomly dealt independently for each hand, the replacement cards will usually be different for each hand. The poker hand rankings are then determined hand by hand and awards are provided to the player.

In one embodiment, a base or primary game may be a keno game wherein the gaming device displays a plurality of selectable indicia or numbers on at least one of the display devices. In this embodiment, the player selects at least one and preferably a plurality of the selectable indicia or numbers by using an input device or by using the touch-screen. The gaming device then displays a series of drawn numbers to determine an amount of matches, if any, between the player's selected numbers and the gaming device's drawn numbers. The player is provided an award, if any, based on the amount of determined matches.

In one embodiment, in addition to winning credits in a base or primary game, the gaming device may also give players the opportunity to win credits in a bonus or secondary game or bonus or secondary round. The bonus or secondary game enables the player to obtain a bonus prize or payout in addition to the prize or payout, if any, obtained from the base or primary game. In general, a bonus or secondary game produces a significantly higher level of player excitement than the base or primary game because it provides a greater expectation of winning than the base or primary game and is accompanied with more attractive or unusual features than the base or primary game.

In one embodiment, the bonus or secondary game may be any type of suitable game, either similar to or completely different from the base or primary game. In one embodiment, the gaming device includes a program code which causes the processor to automatically begin a bonus round when the player has achieved a triggering event, a qualifying condition or other designated game event in the base or primary game. In one embodiment, the triggering event or qualifying condition may be a selected outcome in the primary game or a particular arrangement of one or more indicia on a display device in the primary game, such as the number seven appearing on three adjacent reels along a payline in the primary slot game embodiment seen in FIGS. 1A and 1B. In another embodiment, the triggering event or qualifying condition may be triggered by exceeding a certain amount of game play (number of games, number of credits, amount of time), earning a specified number of points during game play or as a random award.

In one embodiment, once a player has qualified for a bonus game, the player may subsequently enhance their bonus game participation by returning to the base or primary game for continued play. Thus, for each bonus qualifying event, such as a bonus symbol, that the player obtains, a given number of bonus game wagering points or credits may be accumulated in a "bonus meter" programmed to accrue the bonus wagering credits or entries toward eventual participation in a bonus game. The occurrence of multiple bonus qualifying events in the primary game may result in an arithmetic or geometric increase in the number of bonus wagering credits awarded. In one embodiment, extra bonus wagering credits may be redeemed during the bonus game to extend play of the bonus game.

In one embodiment, no separate entry fee or buy in for a bonus game need be employed. That is, a player may not purchase an entry into a bonus game. The player must win or earn entry through play of the primary game, thereby encouraging play of the primary game. In another embodiment, qualification of the bonus or secondary game could be accomplished through a simple "buy in" by the player if, for example, the player has been unsuccessful at qualifying for the bonus game through other specified activities.

Figure 2B:
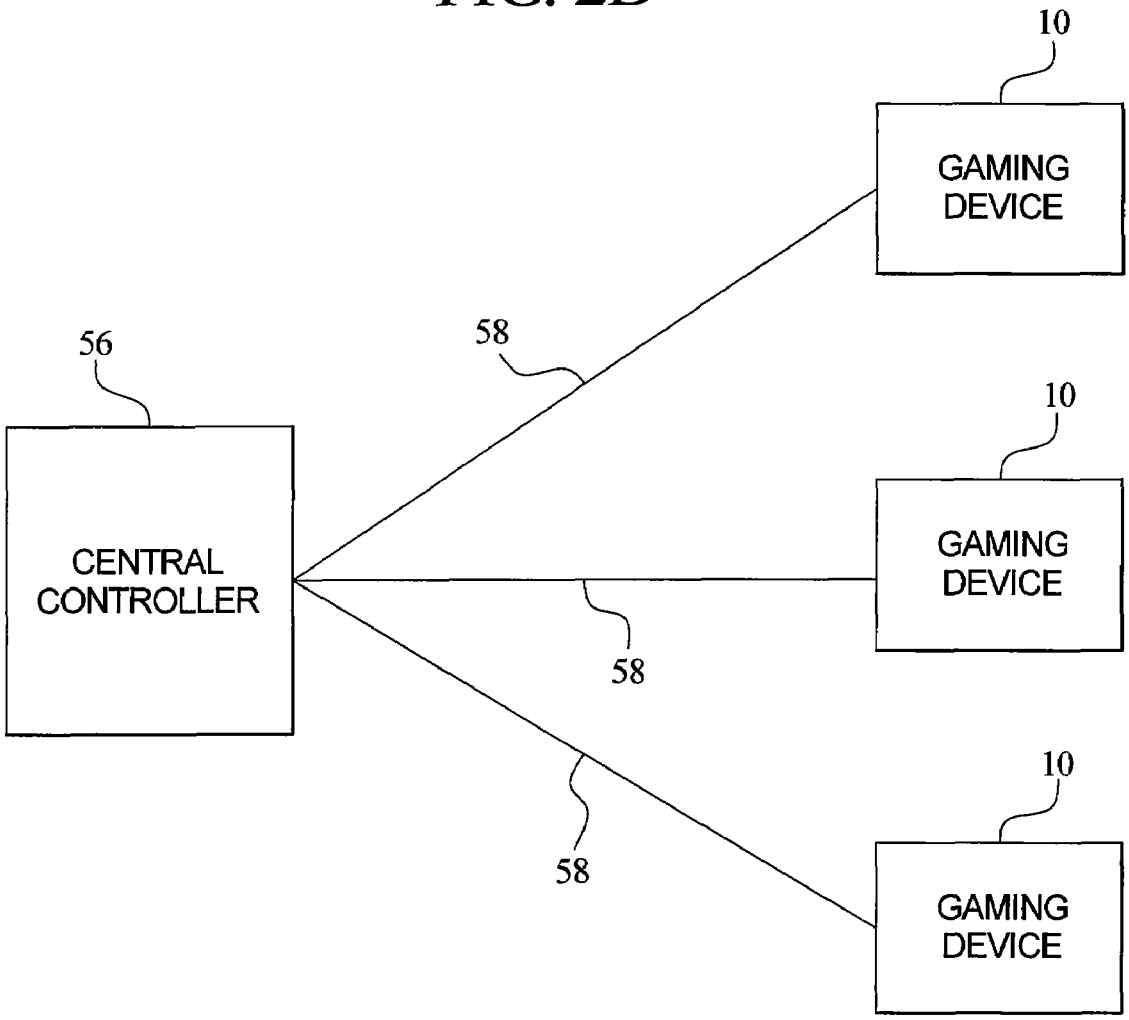
FIG. 2B is a schematic block diagram illustrating a plurality of gaming terminals in communication with a central controller.

In one embodiment, as illustrated in FIG. 2B, one or more of the gaming devices 10 of the present invention may be connected to a data network or a remote communication link 58 with some or all of the functions of each gaming device provided at a central location such as a central server or central controller 56. More specifically, the processor of each gaming device may be designed to facilitate transmission of signals between the individual gaming device and the central server or controller.

In one embodiment, the game outcome provided to the player is determined by a central server or controller and provided to the player at the gaming device of the present invention. In this embodiment, each of a plurality of such gaming devices are in communication with the central server or controller. Upon a player initiating game play at one of the gaming devices, the initiated gaming device communicates a game outcome request to the central server or controller.

In one embodiment, the central server or controller receives the game outcome request and randomly generates a game outcome for the primary game based on probability data. In another embodiment, the central server or controller randomly generates a game outcome for the secondary game based on probability data. In another embodiment, the central server or controller randomly generates a game outcome for both the primary game and the secondary game based on probability data. In this embodiment, the central server or controller is capable of storing and utilizing program code or other data similar to the processor and memory device of the gaming device.

In an alternative embodiment, the central server or controller maintains one or more predetermined pools or sets of predetermined game outcomes. In this embodiment, the central server or controller receives the game outcome request and independently selects a predetermined game outcome from a set or pool of game outcomes. The central server or controller flags or marks the selected game outcome as used. Once a game outcome is flagged as used, it is prevented from further selection from the set or pool and cannot be selected by the central controller or server upon another wager. The provided game outcome can include a primary game outcome, a secondary game outcome, primary and secondary game outcomes, or a series of game outcomes such a free games.

The central server or controller communicates the generated or selected game outcome to the initiated gaming device. The gaming device receives the generated or selected game outcome and provides the game outcome to the player. In an alternative embodiment, how the generated or selected game outcome is to be presented or displayed to the player, such as a reel symbol combination of a slot machine or a hand of cards dealt in a card game, is also determined by the central server or controller and communicated to the initiated gaming device to be presented or displayed to the player. Central production or control can assist a gaming establishment or other entity in maintaining appropriate records, controlling gaming, reducing and/or preventing cheating or electronic or other errors, reducing or eliminating win-loss volatility and the like.

In another embodiment, one or more of the gaming devices of the present invention are in communication with a central server or controller for monitoring purposes only. That is, each individual gaming device randomly generates the game outcomes to be provided to the player and the central server or controller monitors the activities and events occurring on the plurality of gaming devices. In one embodiment, the gaming network includes a real-time or an on-line accounting and gaming information system operably coupled to the central server or controller. The accounting and gaming information system of this embodiment includes a player database for storing player profiles, a player tracking module for tracking players and a credit system for providing automated casino transactions.

A plurality of the gaming devices of the present invention are capable of being connected to a data network. In one embodiment, the data network is a local area network (LAN), in which one or more of the gaming devices are substantially proximate to each other and an on-site central server or controller as in, for example, a gaming establishment or a portion of a gaming establishment. In another embodiment, the data network is a wide area network (WAN) in which one or more of the gaming devices are in communication with at least one off-site central server or controller. In this embodiment, the plurality of gaming devices may be located in a different part of the gaming establishment or within a different gaming establishment than the off-site central server or controller. Thus, the WAN may include an off-site central server or controller and an off-site gaming device located within gaming establishments in the same geographic area, such as a city or state. The WAN gaming system of the present invention may be substantially identical to the LAN gaming system described above, although the number of gaming devices in each system may vary relative to each other.

In another embodiment, the data network is an internet or intranet. In this embodiment, the operation of the gaming device can be viewed at the gaming device with at least one internet browser. In this embodiment, operation of the gaming device and accumulation of credits may be accomplished with only a connection to the central server or controller (the internet/intranet server or webserver) through a conventional phone or other data transmission line, digital signal line (DSL), T-1 line, coaxial cable, fiber optic cable, wireless gateway or other suitable connection. In this embodiment, players may access an internet game page from any location where an internet connection and computer, or other internet facilitator are available. The expansion in the number of computers and number and speed of internet connections in recent years increases opportunities for players to play from an ever-increasing number of remote sites. It should be appreciated that enhanced bandwidth of digital wireless communications may render such technology suitable for some or all communications according to the present invention, particularly if such communications are encrypted. Higher data transmission speeds may be useful for enhancing the sophistication and response of the display and interaction with the player.

In another embodiment, a plurality of gaming devices at one or more gaming sites may be networked to a central server in a progressive configuration, as known in the art, wherein a portion of each wager to initiate a base or primary game may be allocated to bonus or secondary event awards. In one embodiment, a host site computer is coupled to a plurality of the central servers at a variety of mutually remote gaming sites for providing a multi-site linked progressive automated gaming system. In one embodiment, a host site computer may serve gaming devices distributed throughout a number of properties at different geographical locations including, for example, different locations within a city or different cities within a state.

In one embodiment, the host site computer is maintained for the overall operation and control of the system. In this embodiment, a host site computer oversees the entire progressive gaming system and is the master for computing all progressive jackpots. All participating gaming sites report to, and receive information from, the host site computer. Each central server computer is responsible for all data communication between the gaming device hardware and software and the host site computer.

Background Music System

Figure 3:
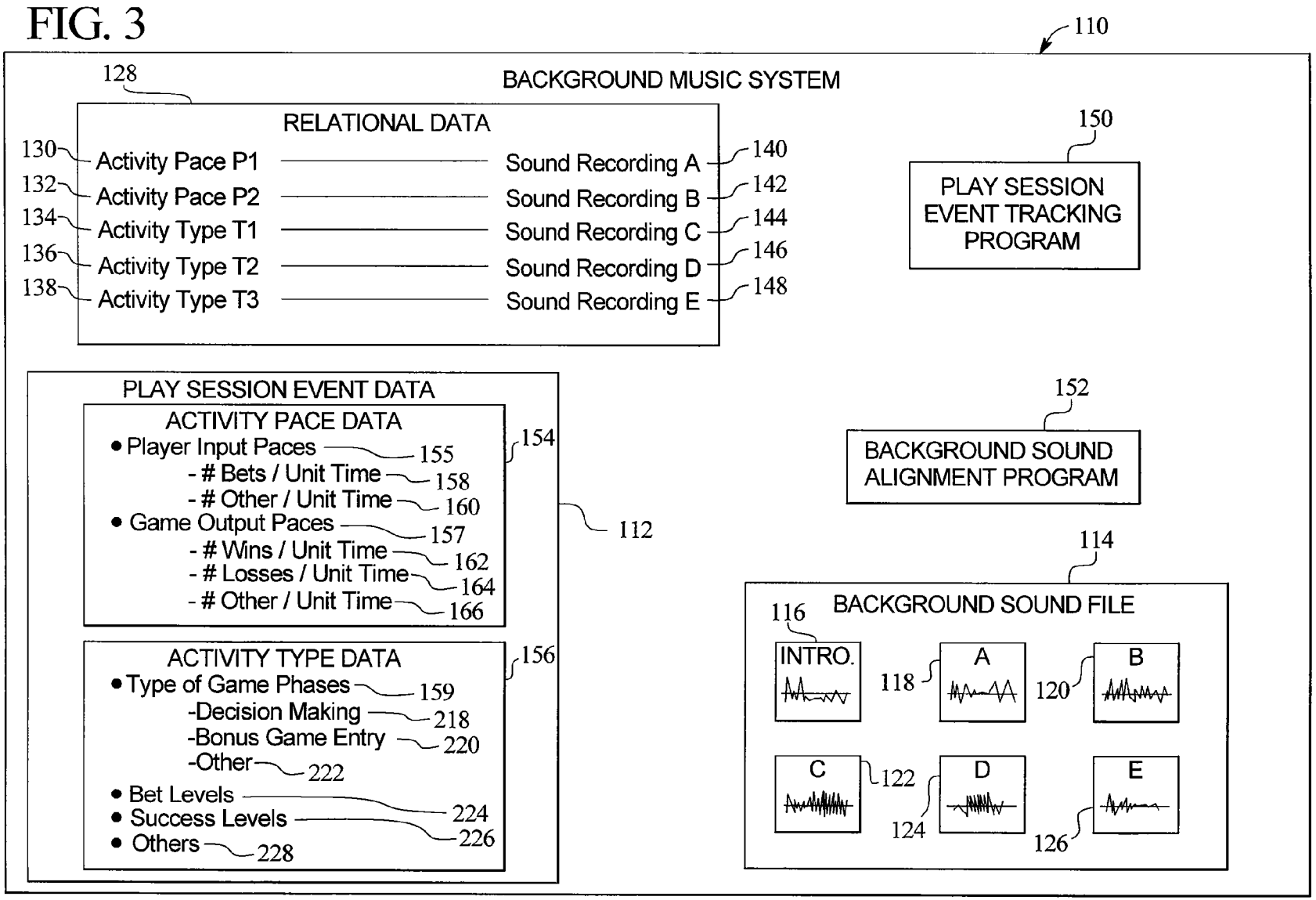
FIG. 3 is a schematic block diagram of the background sound system of the gaming device of one embodiment of the present invention.

Referring now to FIGS. 3 to 11, in one embodiment the present invention includes a background music system 110 which enables the gaming device to produce continuous background music which varies with events which occur during the player's play session for at least one, and preferably a plurality of sequentially played games. The background music can play any time during the play session (including, but not limited to, game play times and the idle or standby times in between game plays), and the background music can continue to play when the play session is over, for example, when the gaming device is in attract mode. As illustrated in FIG. 3, in one embodiment, the background music system 110 includes: (a) play session event information or data 112 collected by the processor and preferably stored in RAM; (b) a background sound file 114 which includes a plurality of different musical pieces or sound recordings 116 to 126; (c) relational information or data 128 which includes a plurality of different play session event identifiers 130 to 138 corresponding to or associated with a plurality of different sound recording identifiers 140 to 148; (d) a play session event monitoring or tracking program 150 for instructing the processor to track the play session data 112; and (e) a background sound alignment program 152 which the processor executes in order to adjust and re-align the background music with the changing events during the play session.

Still referring to FIG. 3, in one embodiment, the play session event data 112 includes activity pace data 154 and activity type data 156. The activity pace data 154 includes information or parameters related to the player's input tempos or paces 155, such as the quantity of bets per unit time 158 and quantity of other types of player inputs per unit time 160. The activity pace data 154 also includes information or parameters related to the game outcome tempos or paces 157, such as the quantity of wins per unit time 162, the quantity of losses per unit time 164 and the quantity of other types of game outcomes per unit time 166. One example of activity pace data 112 is illustrated in FIG. 4. Here, the different quantities of activities per minute 168 to 192 are assigned or otherwise associated with the different pace identifiers 194 to 216. As described above, the relational data 128 preferably associates the different sound recordings with the different activity pace identifiers.

Referring back to FIG. 3, in one embodiment, the activity type data 156 includes information, characteristics or parameters related to the different types of the game phases 159 or stages. The game phases 159 can include a decision-making phase 218, a bonus game entry phase 220 and any other suitable type of game phase 222. The game phase can be any period of time during the play session of one or more games which follows a particular event. The activity type data 156 also includes one or more wager parameters or bet levels 224, one or more success levels 226 and any other type of suitable game activities or play session events 228. In one embodiment, each wager parameter or bet level 224 includes a designated wager amount per unit time or a time independent wager amount. If the player reaches this designated wager amount, the background music changes in the fashion described below. Each success level 226 can include any parameter or factor which specifies one or more wins, losses, ratios of sequential wins to sequential losses, ratios of sequential losses to sequential wins, awards, lack of awards, values, credits, primary game values, bonus game values, opportunities to gain awards or any other outcomes. One example of the activity type data is illustrated in FIG. 5.

Here, the different types of activities 230 to 250 are associated with the different activity type identifiers 252 to 272. As described above, the relational data 128 preferably associates the different sound recordings with the different activity-type identifiers.

Referring again to FIG. 3, in one embodiment each of the musical pieces or sound recordings 116 to 126 is in one embodiment a loop musical composition. It is preferable that each of the musical pieces or sound recordings 116 to 126 includes one or more musical characteristics, including, without limitation, tempo, melody, key, style, beat, syncopation, note, mode, skill, volume, chord, pitch, voice type and instrument type. It should be appreciated that in order to be different, each of the sound recordings 116 through 126 only need to vary by one of these musical characteristics. For example, sound recording 118 may differ from sound recording 120 only in tempo.

As described below, the gaming device of the present invention plays the sound recordings 116 to 126 in variable orders or sequences in order to produce the background music or background sound for the game. It is preferable that each portion 116 to 126 of the background music or background sound is associated with: (a) a mood-type or ambiance; and (b) a theme. In one embodiment, all of the portions 116 to 126 have the same theme, such as the Star Wars™ motion picture theme. Star Wars™ is a trademark of Lucasfilm, Ltd. As such, the background music is associated with a theme which is preferably the same theme of the game title or gaming device title.

In one embodiment, all of the sound recordings 116 to 126 have a common association such as with a motion picture, movie, movie series, television series, play, opera or the like. In one embodiment, the sound recordings 116 to 126 are each different compositions or musical pieces in a soundtrack for a movie series. In one example, the movie series is Star Wars™. Here, the sound recordings 116, 118, 120, 122, 124 and 126 could be Star Wars Main Title™, Throne Room™, Emperor's Arrival™, Victory Celebration™, Duel of the Fates™ and March of the Jedi Knights™, respectively.

In one embodiment, the background music system 110 has a plurality of background sound files. Each file includes a different set of musical pieces, and each file is associated with a different theme. For example, the first file can include a set of musical pieces from the first Star Wars™ motion picture, the second file can include a set of musical pieces from the second Star Wars™ motion picture and the third sound file can include a set of musical pieces from the third Star Wars™ motion picture.

In another embodiment, the music system 110 can include different sets of musical pieces associated with different elements or aspects of a single game. For example, one set of musical pieces can be used with one graphical interface in a game, and a different set of musical pieces can be used with a different graphical interface of the same game.

Figure 6A:
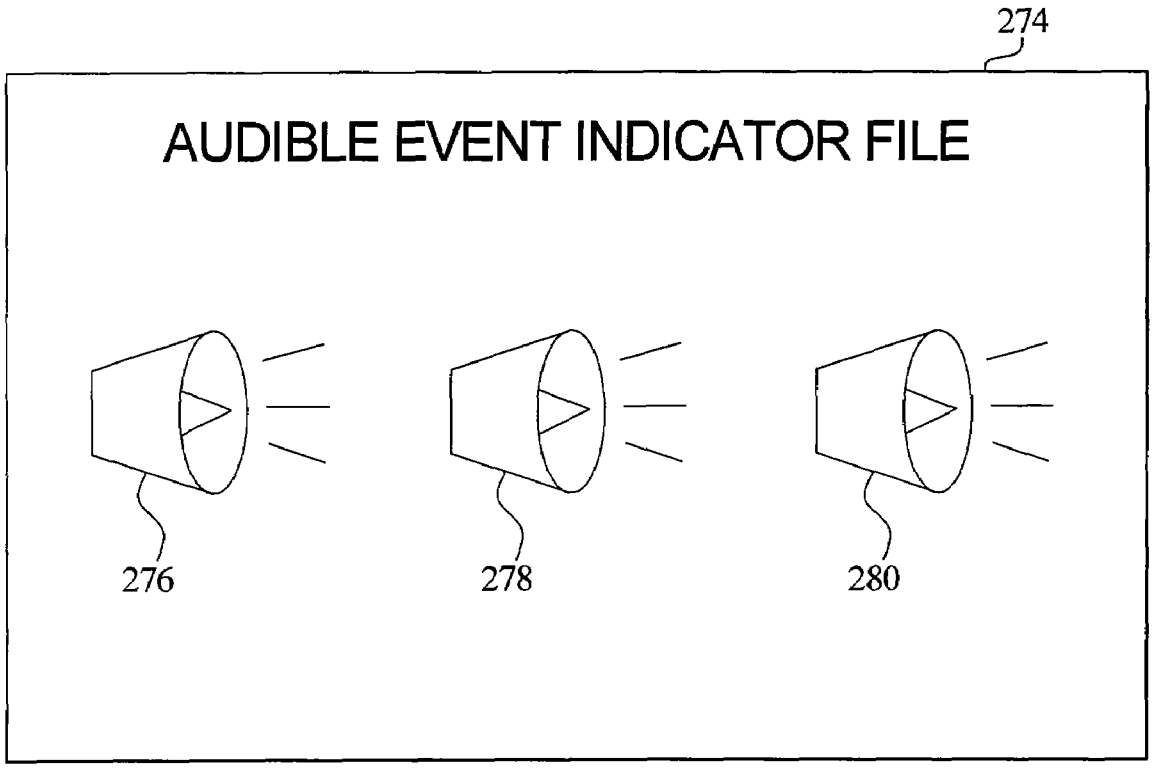
FIG. 6A is a schematic block diagram illustrating the audible indicator sound file in the memory device of one embodiment of the present invention.

Referring to FIG. 6A, in one embodiment, the memory device of the gaming device includes a primary sound file or audible event indicator sound file 274 for providing a plurality of event driven primary sounds, primary music, primary sound recordings or audible event indicators 276 to 280 to the player. Each event driven primary sound or audible event indicator 276, 278 and 280 is preferably a sound effect which is associated with a message to provide information to the player. For example, when the player funds the gaming device, the sound generating device may produce the primary sound or audible event indicator 276 to inform the player of this event. When the player makes an input to place a bet, the sound generating device may, in one example, produce the event driven primary sound or audible indicator 278 to inform the player of this event or otherwise emphasize this event to the player. In another example, when the player reaches a bonus round, the sound generating device may produce a primary sound or audible event indicator 280 to inform the player of this event or otherwise emphasize this event to the player. These sounds from the audible indicators 276, 278 and 280 can be described as primary sounds or foreground sounds in comparison to the background sound or background music produced by playing the sound recordings 116 to 126 in the background sound file 114. In one embodiment, the gaming device simultaneously plays the background sounds and the primary sounds. In one embodiment, the memory device of the present invention includes a primary sound program or audible event indicator program which the processor executes in order to produce a plurality of different event driven primary sounds or audible event indicators when different events occur during the play session. The events can include player inputs, award opportunities and game outcomes, including, without limitation, a bet one input, bet max input, repeat the bet input, cash out input, a win, a loss, a credit roll-up, a bonus event, a game start, a reel stop, a card dealing and any other suitable game event.

In one embodiment, the memory device includes a set of instructions which the processor executes to cause the sound generating device to play the primary sounds while the background music is playing. In this embodiment, one of the differences between the background sound and the primary sounds is that the primary sounds are each associated with a specific purpose to notify the player of a specific game event. It is preferable that each of the primary sounds or primary sound recordings is associated with a distinguishing musical characteristic which distinguishes the primary sound from the in-play background music. For example, the distinguishing musical characteristic could be a relatively high pitch, tone or tempo. In one example, the primary sound is a relatively high pitch and high tempo ding-ding-ding-ding sound.

Figure 6B:
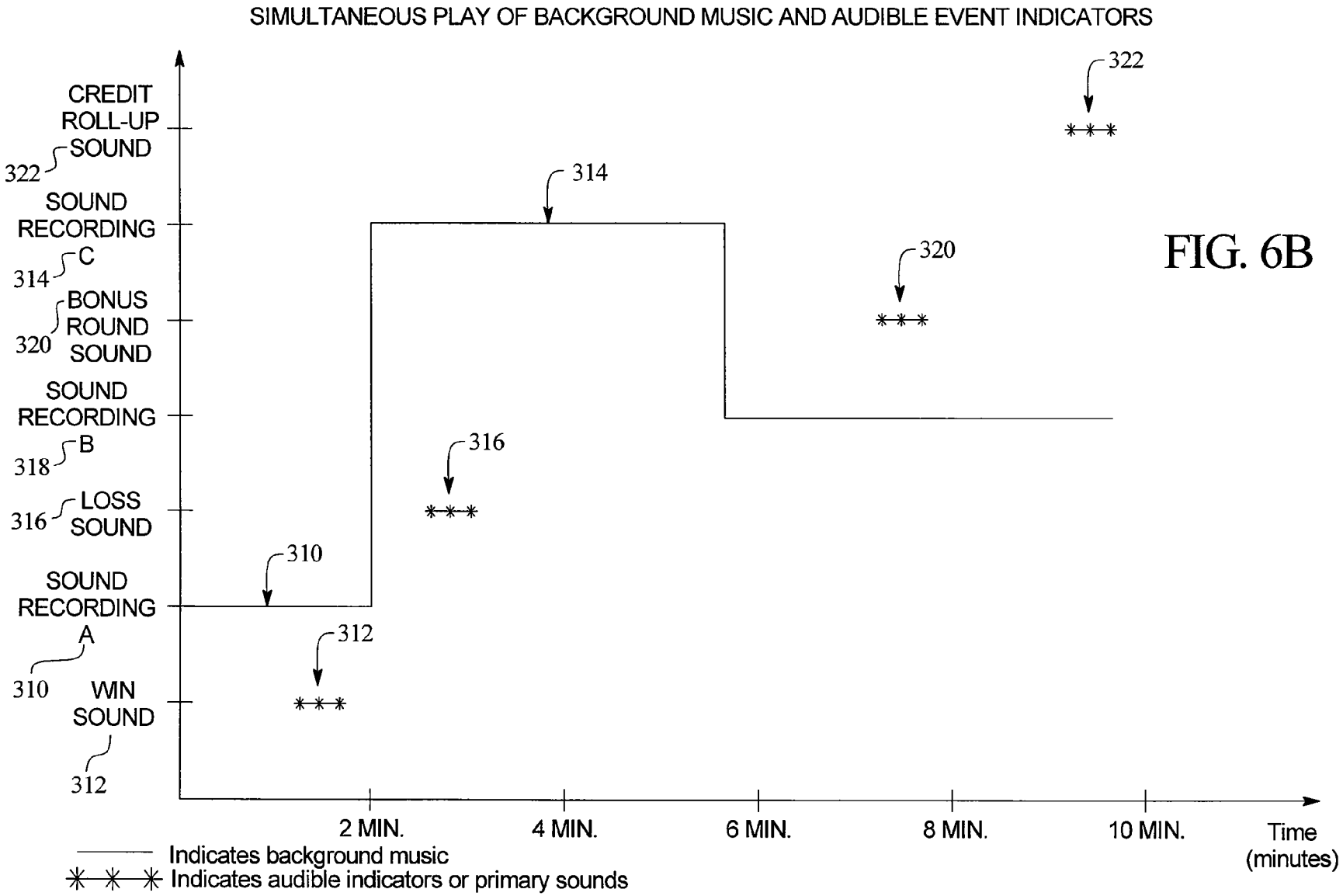
FIG. 6B is a graph illustrating an example in which the background music and the audible indications or primary sounds are played simultaneously.

In one example illustrated in FIG. 6B, the gaming device plays sound recording 310 for the first two minutes of the play session. During the first two minutes, the player makes a win, and the gaming device plays or produces the primary sound recording 312 for a relatively short duration. Next, the gaming device plays the sound recording 314 for the following four minutes of the play session. During this four minutes, the player makes a loss, and the gaming device plays a loss sound 316 for a relatively short duration. Then, the gaming device plays the sound recording 318 during the following four minutes of the play session. During this four minutes, the player reaches a bonus round, and the gaming device plays or produces a bonus round sound 320 for a relatively short period of time. Also, during such four minutes, the player receives a credit roll-up event, and gaming device produces or plays a credit roll-up sound 322 for a relatively short duration.

The play session event tracking program 150 of the system 110 includes one or more instructions or commands. These commands direct the processor to track the status of the play session events by reading the play session event 112 during operation of the game, preferably in real time. In one embodiment, the play session event tracking program 152 directs the processor to determine when a particular player input pace 155 is present, game outcome pace 157 is present, type of game phase 159 is present, bet level 224 is present or success level 226 is present.

Likewise, the background sound alignment program 152 of the system 110 includes one or more instructions or commands. These commands direct the processor to cause the sound generating device to generate one of the background sound recordings 116 to 126 when one of the play session events occur, preferably all in accordance with the relationships set by the relational data 128. In one embodiment, the musical pieces 118 to 126 are stored as a chain or list of pieces. For example, the musical piece list may be as follows: A, B, C, D, C, B, A. Here, the gaming device stores a command which directs the gaming device processor to play a subsequent or next piece or a previous piece. In one example, the gaming device includes a play next command and a play previous command. In another example, the gaming device includes a forward command and a backward command which causes the gaming device to move forward or backward on the music list and to produce the appropriate musical piece. In either such embodiment, when a background music re-alignment event occurs, the gaming device moves to or identifies the immediate musical piece in one direction or the opposite direction on the list. Then the gaming device produces the identified musical piece. For example, the gaming device may be producing piece B when a designated play session event occurs. Here, the event is associated with piece D. The gaming device then identifies and plays musical piece C for a period of time. Then the gaming device identifies and plays piece D. In this embodiment, the gaming device makes musical changes on a sequential piece-by-piece basis.

Example of Background Music Aligned to Play Session Events

Referring to FIG. 7, in one example operation of one embodiment of the present invention, initially the play session begins when the player funds the gaming device to play a game the first of multiple occasions. Next, the player makes a win 282 in the first play of the game, and the system 110 causes the sound generating device to play the victory sound recording 284. In this example, the victory sound recording 284 is associated with a victory mood type 286. Then the player makes a loss 288 in the second play of the game, and the system 110 causes the sound generating device to play the motivation sound recording 290. In this example, the motivation sound recording 290 is associated with a disappointment and motivation mood type 292. Next, the player reaches a high betting pace 294 in the third play of the game, and the system 110 causes the sound generating device to play the excitement sound recording 296. In this example, the excitement sound recording 296 is associated with a high excitement mood type 298.

Then the player reaches a low betting pace 300 in the fourth play of the game, and the system 110 causes the sound generating device to play the motivation sound recording 302. In this example, the motivation sound recording 302 is associated with a low excitement and motivation mood type 304. Next, the player reaches a high winning pace 305 in the fifth play of the game, and the system 110 causes the sound generating device to play the excitement sound recording 306. In this example, the excitement sound recording 306 is associated with a high excitement mood type 308. Then the player reaches a low winning pace 310 in the sixth play of the game, and the system 110 causes the sound generating device to play the motivation sound recording 312. In this example, the motivation sound recording 312 is associated with a low excitement and motivation mood type 314. Next, the player reaches a high success level 316 in the seventh play of the game, and the system 110 causes the sound generating device to play the excitement sound recording 318. In this example, the excitement sound recording 318 is associated with a high excitement mood type 320. Then the player reaches a low success level 322 in the eighth play of the game, and the system 110 causes the sound generating device to play the motivation sound recording 324. In this example, the motivation sound recording 324 is associated with a low excitement and motivation mood type 326.

Finally, the player reaches a decision making game phase 328 in the ninth play of the game, and the system 110 causes the sound generating device to play the mystery sound recording 330. In this example, the mystery sound recording 330 is associated with an inner thought and contemplation mood type 332. The background music for the play session of the nine plays of the game in this example is the combination of sound recordings 284, 290, 296, 302, 306, 312, 318, 324 and 330 in the order described above. It should be understood, however, that the background music for the game, specifically the order and use of such sound records, will vary with the order and occurrence of the play session situation or play session events 282, 288, 294, 300, 305, 310, 316, 322 and 328. Accordingly, the background music during the play session preferably changes from play of the game to play of the game, though it can also change within a single play of the game.

Figure 8:
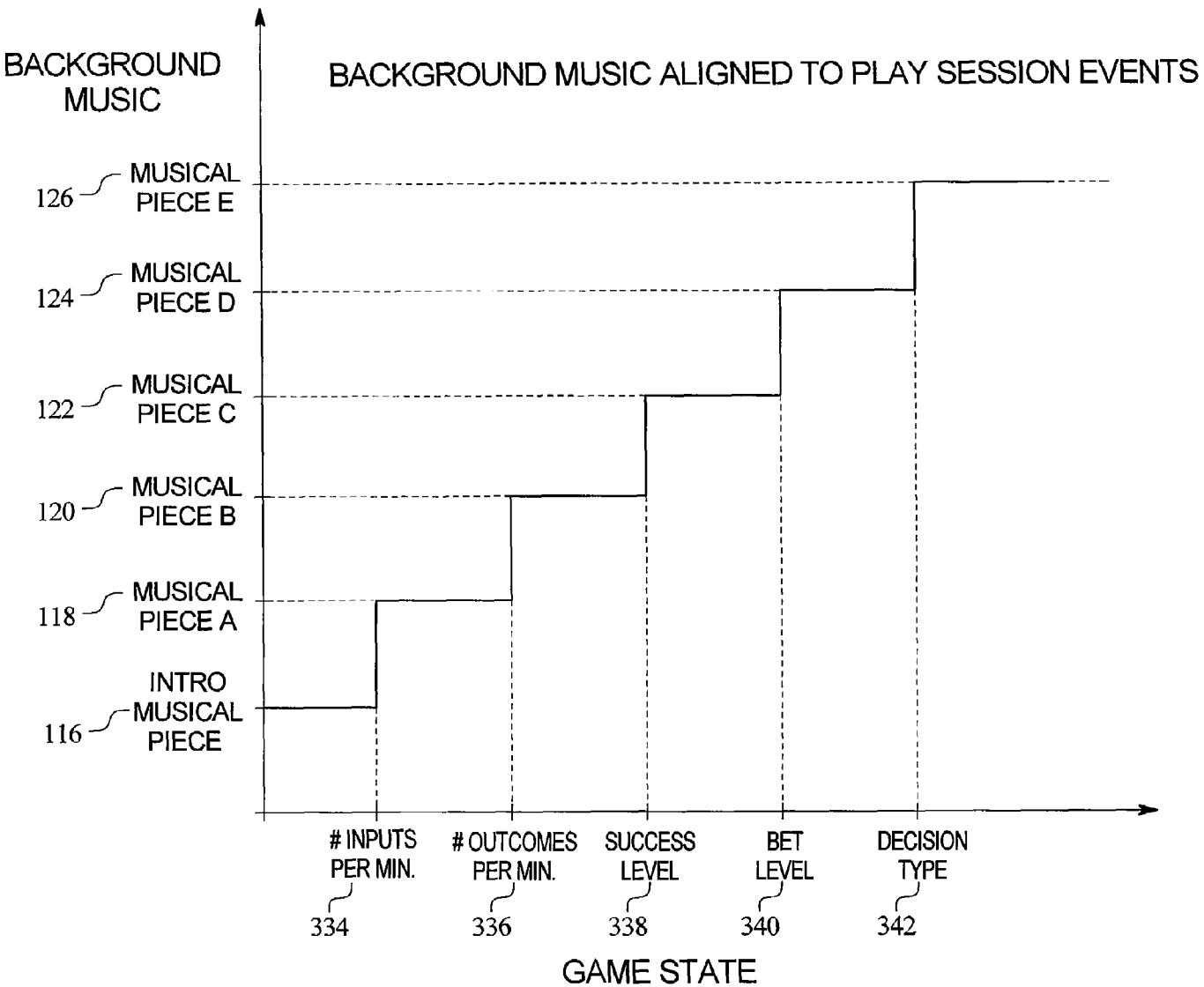
FIG. 8 is a graph illustrating an example in which the background music system of the gaming device is used to adjust and align the background music to the changing play session events of one embodiment of the present invention.

In another example illustrated in FIGS. 3 and 8, when the player funds the gaming device to play a game the first of multiple occasions, the sound generating device automatically plays sound recording 116. Here, sound recording 116 is an introductory musical piece which has a theme which matches the title of the games or gaming device. Using the tracking program 150 and the alignment program 152, the processor determines that the player has made a certain number of inputs 334 during the play session within one minute. In this example, the particular number of inputs 334 detected is a play session event having a play session event identifier 130 which is associated with sound recording identifier 140 in the relational data 128. Therefore, the background music system 110 directs the processor to generate the sound recording 118 associated with the sound recording identifier 140.

As the play session continues, the processor determines that the player has reached a certain number or quantity of outcomes 336 within one minute. This quantity of outcomes 336 is associated with a play session event identifier 132 stored in association with the sound recording identifier 142 in the relational data 128. Therefore, the processor directs the sound generating device to automatically play sound recording 118 which is associated with sound recording identifier 142. As the play session continues, the processor, using the system 110, determines that the player has reached a particular success level 338 during the play session. This particular success level 338 is associated with the play session event identifier 134 stored in association with the sound recording identifier 144 in the relational data 128. Therefore, the processor directs the sound generating device to automatically produce and play the sound recording 120 which is associated with the sound recording identifier 144.

As the play session continues, the processor determines that the player has made a certain bet which meets a success level 338. The play session event identifier 136 is associated with the success level 338. The relational data 128 stores the play session event identifier 136 in association with the sound recording identifier 144. Therefore, the processor causes the sound generating device to automatically play the sound recording 122 which is associated with the sound recording identifier 144.

As the play session continues, the processor determines that the player has made a certain bet which meets a bet level 340. The play session event identifier 138 is associated with the bet level 340. The relational data 128 stores the play session event identifier 138 in association with the sound recording identifier 146. Therefore, the processor causes the sound generating device to automatically play the sound recording 124 which is associated with the sound recording identifier 146.

Finally, the processor, using the system 110, determines that the player is facing a particular decision type 342 during the play session. This particular decision type 342 is associated with play session event identifier 138. The play session event identifier 138 is stored in the relational data 128 in association with sound recording identifier 148. Therefore, the processor causes the sound generating device to automatically produce the sound recording 126 which is associated with the sound recording identifier 148. The combination of sound recordings 116 to 126 results in a background music for the play session. As illustrated in this example, the system 110 causes the background music to automatically adjust and align itself to the differing play session events encountered by the player during operation of the gaming device.

In another embodiment, between the third and the fourth minute, the player makes only two bets. Here, rather than resetting to piece 118, the gaming device plays piece 120. Depending upon the embodiment, the gaming device may play piece 120 temporarily and then play piece 118, or the gaming device may continue to play piece 120 until another bet pace event occurs.

Example of Background Music Aligned to Bet Pace

Figure 9:
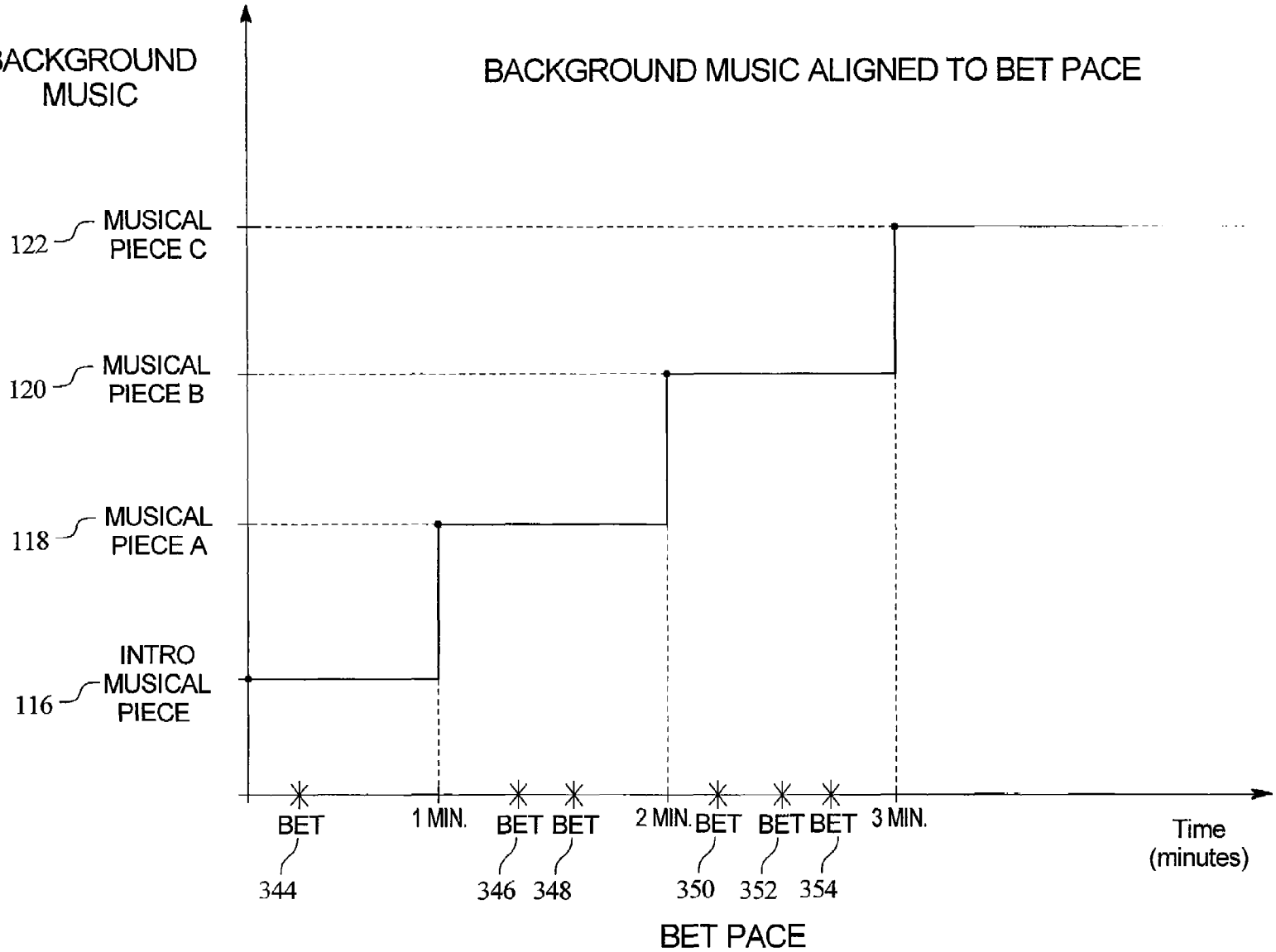
FIG. 9 is a graph illustrating an example in which the background music system of the gaming device is used to adjust and align the background music to the changing bet tempos or paces of one embodiment of the present invention.

Referring now to FIGS. 3 and 9, in one example of one embodiment, the processor uses the system 110 to construct or compose the background music for a play session for a series of plays of one or more games based on the pace at which the player makes bets during that play session. In this example, when the player funds the gaming device, the sound generating device produces introduction musical piece or sound recording 116. Within one minute after the beginning of the play session, the player makes one input to make one bet 344. In this example, the system 110 includes relational data 128 which associates one bet per minute with musical piece or sound recording 118. Accordingly, the processor uses the system 110 to cause the sound generating device to play the sound recording 118 at the time of one minute after the play session begins.

Within the following minute during the play session, the player makes two inputs to make two bets 346 and 348. In this example, the system 110 includes information or data in the relational data 128 which associates two bets per minute with musical piece or sound recording 120. Accordingly, the processor causes the sound generating device to play the sound recording 120 at the point of two minutes after the beginning of the play session.

Within the following minute during the play session, the player makes three inputs to make three bets 350, 352 and 354. In this example, the relational data 128 of the system 110 includes data or information which associates three bets per minute with the sound recording or musical piece 122. Therefore, the processor causes the sound generating device to play the musical piece 122. This process of monitoring the number of bets made per minute and playing different sound recordings continues, preferably until the play session terminates, for example, when the player cashes out.

Example of Background Music Aligned to Win Pace

Figure 10:
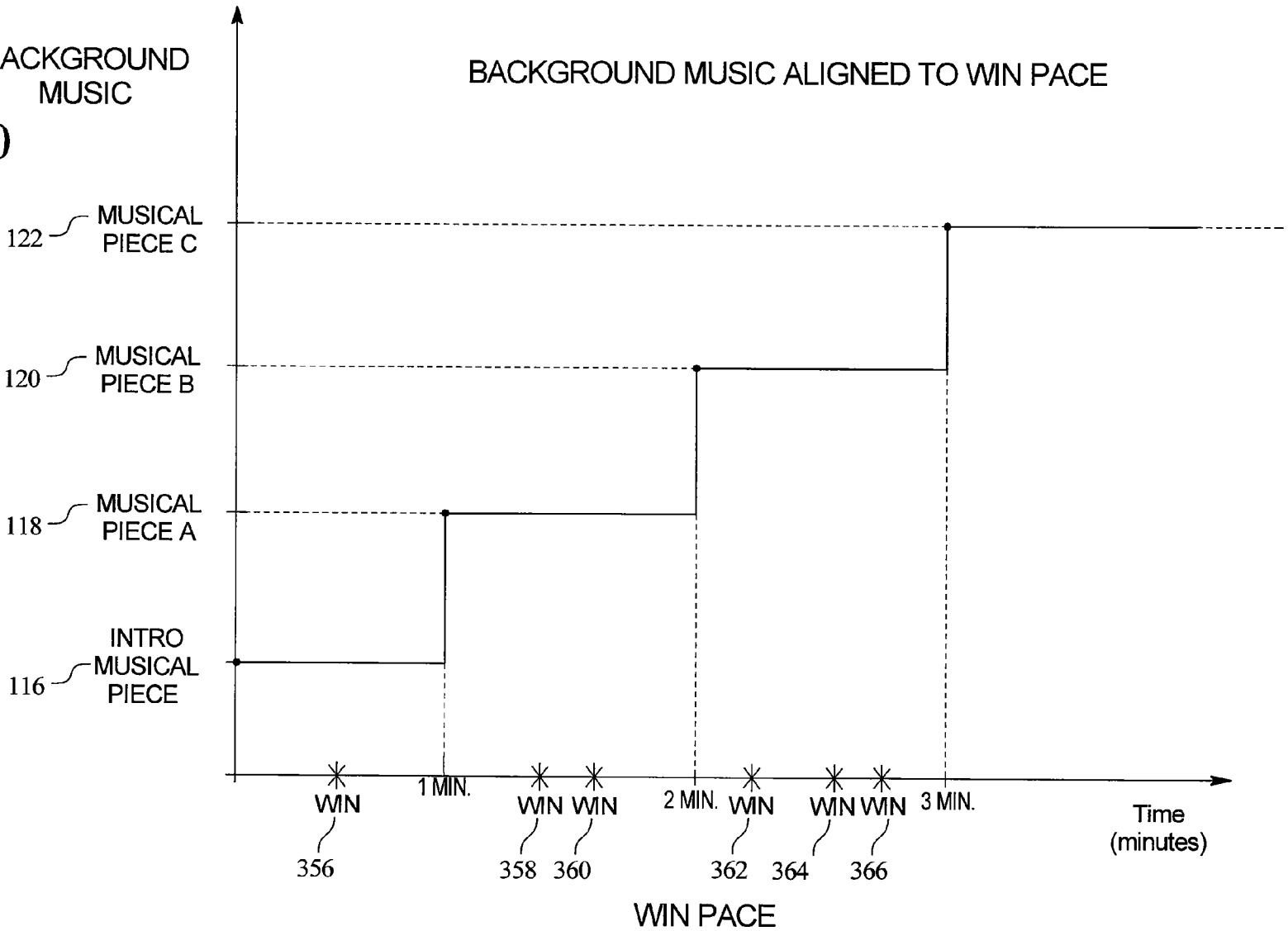
FIG. 10 is a graph illustrating an example in which the background music system of the gaming device is used to adjust and align the background music to the changing win tempos or paces of one embodiment of the present invention.

Referring to FIGS. 3 and 10, in another example of one embodiment, the player funds the gaming device to begin a play session for a series of plays of one or more games, and the sound generating device initially plays an introduction musical piece 116. Within one minute after the beginning of the play session, the player achieves a win 356. The relational data 128 of the system 110 includes data which relates one win per minute with the sound recording or musical piece 118. Accordingly, the processor, as instructed by system 110, causes the sound generating device to play the musical piece 118. Within the following minute, the player achieves two wins 358 and 360. Here, the relational data 128 of the system 110 includes information which relates two wins per minute to the sound recording or musical piece 120. Accordingly, the processor uses the system 110 to cause the sound generating device to play the musical piece 120. Within the following minute, the player achieves three wins 362, 364 and 366. The relational data 128 of the system 110 includes information which associates three wins per minute with the sound recording or musical piece 122. Accordingly, the processor uses the system 110 to cause the sound generating device to play the musical piece 122. This process preferably continues until the play session terminates, for example, when a player cashes out.

In another embodiment, between the third and fourth minute, the player makes only two wins. Here, rather than resetting to piece 118, the gaming device plays piece 120. Depending upon the embodiment, the gaming device may play piece 120 temporarily and then play piece 118, or the gaming device may continue to play piece 120 until another win pace occurs.

Example of Background Music Aligned to Success Level

Figure 11:
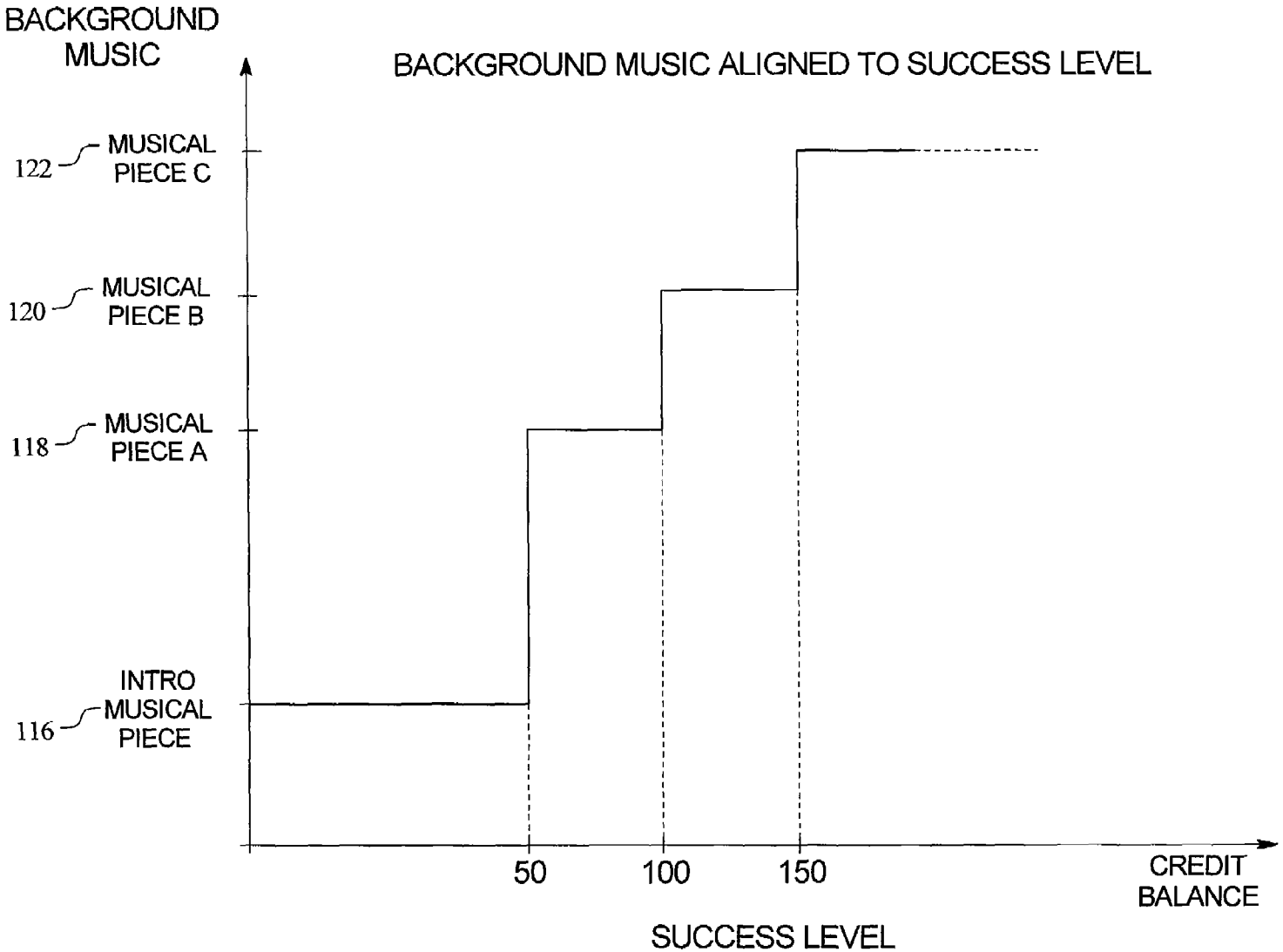
FIG. 11 is a graph illustrating an example in which the background music system of the gaming device is used to adjust and align the background music to the changing success levels of one embodiment of the present invention.

Referring to FIGS. 3 and 11, in one example of another embodiment, the gaming device initiates a play session for a series of plays of one or more games when the player funds the gaming device. Upon initiation of the play session, the processor causes the sound generating device to play introduction musical piece or sound recording 116. During the play session, eventually the player accumulates a credit balance of fifty. The relational data 128 of the system 110 includes information which associates a credit balance of fifty with the sound recording or musical piece 118. Accordingly, the processor, as instructed by the system 110, causes the sound recording device to play musical piece 118.

As the play session continues, eventually the player accumulates a credit balance of one hundred. In this example, the relational data 128 of the system 110 includes data which associates a credit balance of one hundred with the musical piece or sound recording 120. Accordingly, the processor, as instructed by the system 110, causes the sound generating device to automatically play the musical piece or sound recording 120. As the play session continues, eventually the player accumulates a credit balance of one hundred fifty. In this example, the relational data 128 of the system 110 includes data which associates a credit balance of one hundred fifty with the musical piece or sound recording 122. Accordingly, the processor, as instructed by the system 110, causes the sound generating device to play the sound recording 122. Preferably, this process continues until the play session terminates, for example, when the player cashes-out.

It is preferable that the gaming device makes changes in the background music by stopping the play of one musical piece and starting the play of a different musical piece as described above. Here, the memory device can include one or more mix, fade or transitional sound recordings. In one embodiment, the gaming device plays one of these transitional sound recordings when switching from one piece of background music to another piece of background music. The transitional sound recordings can reduce the sound effects of off-beat musical switches, and in other cases, the transitional sound recordings can increase pleasurable-sounding musical switches.

In one embodiment, the background sound system (not shown) need not include a plurality of sound recordings or musical pieces. Rather, this background sound system includes at least one suitable sound editor program. The sound editor program includes a set of commands or instructions which direct the processor to automatically change one or more of the musical characteristics of a single musical piece or sound recording. Here, when the play session events change, the processor, using the sound editor (and other portions of the background music system), causes the sound generating device to play a modification of or altered version of the single sound recording.

In certain embodiments the background music system of the present invention controls the play of background music during the play session which begins when the player initially funds the gaming device and ends when the player cashes-out. Here, it is preferable that the player plays a sequence or series of games before cashing-out and walking away from the gaming device. In these embodiments, the play session is the period of time between the gaming device funding event and the cash-out event.

In other embodiments, the play session extends beyond the cash-out event. Here, the play session can continue for a designated amount of time after the cash-out event. For example, the background music system can continue to control the background music during an attract mode for a period of five minutes after the player cashes out.

In one embodiment of the present invention, the active type data 228 includes advance data and decline data. The advance data is associated with the player's inputs to proceed with playing the game or is otherwise associated with the player's advancement in the game. The decline data is associated with the player's inputs to decline play opportunities or is otherwise associated with the player's decline or failure to advance in the game. The gaming device uses this advance data and decline data to track when the player reaches a designated advance or decline threshold, each of which is associated with a designated musical piece in the said file. Accordingly, as the player advances in a game, the music system moves upward along a sequence of musical pieces. As the player declines in a game, the music system moves downward along a sequence of musical pieces.

It should be appreciated that the play session event data which triggers musical changes can include any suitable combination of any portion or portions of the data activity pace data 154 and/or activity type data 156. For example, the play session event data can include a parameter which triggers a musical change if the player makes a designated number of bets and a designated number of wins per unit time. In another example, the parameter may be a combination of a designated aggregate wager amount per unit time and a designated award level.

The gaming device of the present invention, in one embodiment, includes a background music system which causes the gaming device to automatically vary or adjust the background music of the gaming device. The history of play session events functions as the trigger for musical changes in the background music. Though the musical changes are based on the play session events, the background music can play: (a) anytime during the play session, including, without limitation, during play of a game, during the idle, inactive or standby time in between games or for a period of time after the game ends; and (b) after the play session is over, for example, when the gaming device is in attract mode. In one embodiment, the background music system directs the processor to: (a) monitor the quantity of inputs the player makes over a period of time; (b) monitor the quantity of outcomes the player reaches over a period of time; and/or (c) monitor the types of decisions the player is facing or other play session events encountered by the player. By monitoring and tracking the status of these activities, the background music system enables the gaming device to play designated musical pieces consistent with the themes of the situations faced by the player. For example, if the player is making inputs or placing bets at a relatively high pace or tempo, the gaming device can play a musical piece with a high tempo. Alternatively, if the player is facing a decision, the gaming device can play a mysterious sounding musical piece. Together, these musical pieces form the background music of the game. This type of gaming device increases and enhances entertainment and excitement for players.

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention claimed is:

1. A gaming device controlled by a processor, the gaming device comprising:

a game playable by a player on multiple occasions based on multiple bets at a desired betting pace;

information associated with a plurality of designated betting paces;

at least one speaker operable to simultaneously produce background music and a plurality of event driven primary sounds during the multiple plays of the game; and at least one command which the processor executes to:

(a) track the player's betting pace; and (b) cause the background music to be modified based on whether the tracked betting pace matches one of the designated betting paces.

2. The gaming device of claim 1, which includes information that relates the designated betting paces to a plurality of different musical characteristics, the processor causing the background music to have at least one of the musical characteristics based on whether the tracked betting pace matches the designated betting pace which is related to said at least one musical characteristic.

3. The gaming device of claim 2, wherein each one the musical characteristics is selected from the group consisting of tempo, melody, key, style, beat, syncopation, note, mode, scale, volume, chord, pitch, voice type and instrument type.

4. The gaming device of claim 2, which includes at least one command which the processor executes to cause the modified background music to be produced during a time period selected from the group consisting of the time period during at least one of the plays of the game and the time period during all of the plays of the game.

5. The gaming device of claim 2, which includes at least one command which the processor executes to cause the modified background music to be produced during a time period selected from the group consisting of the time period in between a plurality of the plays of the game, the time period after the plays of the game, the time period during which the gaming device is funded and the time period after the player cashes out.

6. The gaming device of claim 1, which includes at least one command which directs the processor to cause the speaker to produce the event driven primary sounds when designated game events occur.

7. The gaming device of claim 6, wherein the event driven primary sounds include an audible event indicator which is selected from the group consisting of a sound effect, a sound associated with an image and a voice.

8. The gaming device of claim 1, wherein the background music is continuously played.

9. A gaming device controlled by a processor, the gaming device comprising:

a game operable upon a wager which is playable by a player on multiple occasions during a play session;

an input device which enables the player to make a desired quantity of inputs per unit time during the play session;

information associated with a group of different designated quantities of inputs per unit time;

at least one sound generating device operable to simultaneously produce a background sound and primary sound during the play session; and at least one instruction which directs the processor to:

(a) track the player's quantity of inputs per unit time; and (b) cause the background sound to be modified based on whether the tracked quantity of inputs per unit time matches one of the designated quantities of inputs per unit time.

10. The gaming device of claim 9, which includes information that associates the designated quantities of inputs per unit time with a plurality of different musical characteristics, the processor causing the background sound to have at least one of the musical characteristics based on whether the tracked quantity of inputs per unit time matches the designated quantity of inputs per unit time which is related to said at least one musical characteristic.

11. The gaming device of claim 10, wherein each one of the musical characteristics is selected from the group consisting of tempo, melody, key, style, beat, syncopation, note, mode, scale, volume, chord, pitch, voice type and instrument type.

12. The gaming device of claim 9, which includes at least one instruction which directs the processor to cause the sound generating device to produce the primary sound when a designated game event occurs during the play session.

13. The gaming device of claim 9, wherein the primary sound includes an audible event indicator which is selected from the group consisting of a sound effect, a sound associated with an image and a voice.

14. The gaming device of claim 9, which includes at least one instruction which directs the processor to cause the modified background sound to be produced during a time period selected from the group consisting of the time period during at least one of the plays of the game and the time period during all of the plays of the game.

15. The gaming device of claim 9, which includes at least one instruction which directs the processor to cause the modified background sound to be produced during a time period selected from the group consisting of the time period in between a plurality of the plays of the game, the time period after the plays of the game, the time period during which the gaming device is funded and the time period after the player cashes out.

16. The gaming device of claim 9, wherein the background sound is continuously played.

17. A gaming device controlled by a processor, the gaming device comprising:

a game playable by a player on multiple occasions based on multiple bets during a play session;

a set of game rules which direct the processor to enable the player to reach multiple wins at a win pace in response to the player's multiple bets;

information associated with a group of designated win paces;

at least one speaker operable to simultaneously produce background music and event driven primary sound during the play session; and at least one command which instructs the processor to:

(a) track the win pace during the play session; and (b) cause the background music to be modified based on whether the tracked win pace matches one of the designated win paces.

18. The gaming device of claim 17, which includes information that relates the designated win paces to a plurality of different musical characteristics, the processor causing the background music to have at least one of the musical characteristics based on whether the tracked betting pace matches the designated win pace which is related to said at least one musical characteristic.

19. The gaming device of claim 18, wherein each one of the musical characteristics is selected from the group consisting of tempo, melody, key, style, beat, syncopation, note, mode, scale, volume, chord, pitch, voice type and instrument type.

20. The gaming device of claim 17, which includes at least one command which directs the processor to cause the speaker to produce the event driven primary sound when a designated game event occurs.

21. The gaming device of claim 17, wherein the event driven primary sound includes an audible event indicator which is selected from the group consisting of a sound effect, a sound associated with an image and a voice.

22. The gaming device of claim 17, which includes at least one command which the processor executes to cause the speaker to produce the modified background music during a time period selected from the group consisting of the time period during at least one of the plays of the game and the time period during all of the plays of the game.

23. The gaming device of claim 17, which includes at least one command which the processor executes to cause the speaker to produce the modified background music during a time period selected from the group consisting of the time period in between a plurality of the plays of the game, the time period after the plays of the game, the time period during which the gaming device is funded and the time period after the player cashes out.

24. The gaming device of claim 17, wherein the background music is continuously played.

25. A gaming device controlled by a processor, the gaming device comprising:

a game operable upon a wager which is playable by a player on multiple occasions during a play session;

an input device which enables the player to provide different inputs during the play session;

a set of game rules which direct the processor to provide the player with different outcomes after the player provides the different inputs during the play session;

information associated with a group of different designated quantities of outcomes per unit time;

at least one sound generating device operable to simultaneously produce a background sound and a primary sound during the play session; and at least one instruction which directs the processor to:

(a) track the quantity of the outcomes per unit time; and (b) cause the background sound to be modified based on whether the tracked quantity of outcomes per unit time matches one of the designated quantities of outcomes per unit time.

26. The gaming device of claim 25, which includes information that associates the designated quantities of outputs per unit time with a plurality of different musical characteristics, the processor causing the background sound to have at least one of the musical characteristics based on whether the tracked quantity of outputs per unit time matches the designated quantity of outputs per unit time which is related to said at least one musical characteristic.

27. The gaming device of claim 26, wherein each one of the musical characteristics is selected from the group consisting of tempo, melody, key, style, beat, syncopation, note, mode, scale, volume, chord, pitch, voice type and instrument type.

28. The gaming device of claim 25, which includes at least one instruction which directs the processor to cause sound generating device to produce the primary sound when designated event occurs during the play session.

29. The gaming device of claim 28, wherein the primary sound includes an audible event indicator which is selected from the group consisting of a sound effect, a sound associated with an image and a voice.

30. The gaming device of claim 25, wherein the different outcomes include an outcome selected from the group consisting of a win, a loss, a ratio of sequential wins to sequential losses, a ratio of sequential losses to sequential wins, an award, a lack of award, a value, a primary game value, a bonus game value, a gain in an opportunity to gain an award and a loss in an opportunity to gain an award.

31. The gaming device of claim 25, which includes at least one instruction which directs the processor to cause the sound generating device to produce the modified background sound during a time period selected from the group consisting of the time period during at least one of the plays of the game and the time period during all of the plays of the game.

32. The gaming device of claim 25, which includes at least one instruction which directs the processor to cause the sound generating device to produce the modified background sound during a time period selected from the group consisting of the time period in between a plurality of the plays of the game, the time period after the plays of the game, the time period during which the gaming device is funded and the time period after the player cashes out.

33. The gaming device of claim 25, wherein the background sound is continuously played.

34. A gaming device controlled by a processor, the gaming device comprising:

a game operable upon a wager which is playable by a player on multiple occasions during a play session, the game having a theme;

an input device which enables the player to provide a desired quantity of inputs per unit time during the play session;

information which includes an association of a plurality of different designated quantities of inputs per unit time with a plurality of different musical characteristics;

at least one sound generating device operable to simultaneously output:

(a) a plurality of audible event indicators operable to indicate different game events to the player which occur during the play session;

(b) background music which has a theme consistent with the theme of the game, wherein the background music includes the different musical characteristics played in an order and the order at which the musical characteristics are played in the background music varies with the player's quantity of inputs per unit time during the play session;

at least one instruction which directs the processor to:

(a) track the player's quantity of inputs per unit time during the play session;

(b) cause the background music to be modified based on whether the tracked quantity of inputs per unit time matches one of the designated quantities of inputs per unit time; and (c) repeat said tracking and modification steps on at least one occasion during the play session;

a plurality of awards associated with the game; and a display device operable to display a plurality of images associated with the game.

35. The gaming device of claim 34, wherein each one of the different musical characteristics has a characteristic selected from the group consisting of tempo, melody, key, style, beat, syncopation, note, mode, scale, volume, chord, pitch, voice type and instrument type.

36. The gaming device of claim 35, wherein each one of the different musical characteristics is associated with a different mood type.

37. The gaming device of claim 36, wherein the mood types include a mood type selected from the group consisting of low excitement, medium excitement, high excitement, climax, mystery, contemplation, anticipation, hopefulness, happiness, success, optimism, inspiration, motivation, perseverance, adventure, fear, danger, disappointment and failure.

38. The gaming device of claim 37, wherein the images includes at least one image associated with each of the mood types.

39. The gaming device of claim 38, which includes an instruction which directs the processor to cause the sound generating device and the display device to simultaneously output one of the musical characteristics and one of the images, said musical characteristic and said image being associated with an identical mood type.

40. The gaming device of claim 34, which includes at least one instruction which causes the sound generating device to sequentially produce different ones of the musical characteristics.

41. The gaming device of claim 34, which includes at least one instruction which directs the processor to cause the sound generating device to produce the modified background music during a time period selected from the group consisting of the time period during at least one of the plays of the game and the time period during all of the plays of the game.

42. The gaming device of claim 34, which includes at least one instruction which directs the processor to cause the sound generating device to produce the modified background music as part of the background music during a time period selected from the group consisting of the time period in between a plurality of the plays of the game, the time period after the plays of the game, the time period during which the gaming device is funded and the time period after the player cashes out.

43. The gaming device of claim 34, wherein the background music is continuously played.

44. A method for operating a gaming device, said method comprising:

(a) enabling a player to initiate a game on multiple occasions during a play session;
(b) playing a background sound for the play session;
(c) receiving a quantity of inputs per unit time from the player during the play session;
(d) tracking the quantity of inputs per unit time; and
(e) modifying the background sound being played based on whether the tracked quantity of inputs per unit time corresponds with one of plurality of designated quantities of inputs per unit time.

45. The method of claim 44, wherein the step of playing the background sound includes the step of causing the background sound to have at least one musical characteristic selected from a plurality of different musical characteristics.

46. The method of claim 45, wherein each one of the musical characteristics is selected from the group consisting of tempo, melody, key, style, beat, syncopation, note, mode, scale, volume, chord, pitch, voice type and instrument type.

47. The method of claim 44, wherein the step of modifying the background sound includes the step of playing the modified background sound during a time period selected from the group consisting of the time period during at least one play of the game and the time period during all of a plurality of plays of the game.

48. The method of claim 44, wherein the step of modifying the background sound includes the step of playing the modified background sound during a time selected form the group consisting of the time period in between a plurality of plays of the game, the time period after all of a plurality of plays of the game, the time period during which the gaming device is funded and the time period after the player cashes out.

49. A method for operating a gaming device, said method comprising:

(a) enabling a player to initiate a game on multiple occasions during a play session;
(b) playing a background sound for the play session;
(c) providing the player with a quantity of outcomes per unit time during the play session;
(d) tracking the quantity of outcomes per unit time; and
(e) modifying the background sound being played based on whether the tracked quantity of outcomes per unit time corresponds with one of a plurality of designated quantities of outcomes per unit time.

50. The method of claim 49, wherein the step of playing the background sound includes the step of causing the background sound to have at least one musical characteristic selected from a plurality of different musical characteristics.

51. The method of claim 50, wherein each one of the musical characteristics is selected from the group consisting of tempo, melody, key, style, beat, syncopation, note, mode, scale, volume, chord, pitch, voice type and instrument type.

52. The method of claim 49, wherein the step of providing the player with a quantity of outcomes per unit time during the play session includes the step of providing an outcome selected from the group consisting of a win, a loss, a ratio of sequential wins to sequential losses, a ratio of sequential losses to sequential wins, an award, a lack of award, a value, a primary game value, a bonus game value, a gain in an opportunity to gain an award and a loss in an opportunity to gain an award.

53. The method of claim 49, wherein the step of modifying the background sound includes the step of playing the modified background sound during a time period selected from the group consisting of the time period during at least one play of the game and the time period during all of a plurality of plays of the game.

54. The method of claim 49, wherein the step of modifying the background sound includes the step of playing the modified background sound during a time selected form the group consisting of the time period in between a plurality of plays of the game, the time period after all of a plurality of plays of the game, the time period during which the gaming device is funded and the time period after the player cashes out.

55. A method for operating a gaming device, said method comprising:

(a) enabling a player to initiate multiple plays of a game on multiple occasions during a play session, wherein the player selects a wager amount for each of the plays;
(b) playing a background sound;
(c) tracking the wager amounts per unit time; and
(d) modifying the background sound being played based on whether the tracked quantity of wager amounts per unit time corresponds with one of a plurality of designated quantities of wager amounts per unit time.

56. The method of claim 55, wherein the step of playing the background sound includes the step of causing the background sound to have at least one musical characteristic selected from a plurality of different musical characteristics.

57. The method of claim 56, wherein each one of the musical characteristics is selected from the group consisting of tempo, melody, key, style, beat, syncopation, note, mode, scale, volume, chord, pitch, voice type and instrument type.

58. The method of claim 55, wherein the step of modifying the background sound includes the step of playing the modified background sound during a time period selected from the group consisting of the time period during at least one of the plays of the game and the time period during all of the plays of the game.

59. The method of claim 55, wherein the step of modifying the background sound includes the step of playing the modified background sound during a time selected form the group consisting of the time period in between a plurality of the plays of the game, the time period after all of the plays of the game, the time period during which the gaming device is funded and the time period after the player cashes out.

60. A gaming device having a game operable upon a wager so as to have a plurality of different success levels reachable by a player during at least one play of the game, the gaming device operable by a processor, the gaming device comprising:

information associated with a group of different designated success levels;

a sound generating device operable to produce a background sound and a primary sound during the play of the game; and at least one instruction which directs the processor to:

(a) track the success level reached by the player during the play of the game; and (b) cause the background sound to be modified based on whether the tracked success level corresponds with one of the designated success levels.

61. The gaming device of claim 60, which includes information that relates the designated success levels to a plurality of different musical characteristics, the processor causing the background sound to have at least one of the musical characteristics based on whether the tracked success level corresponds with the designated success level which is related to said at least one musical characteristic.

62. The gaming device of claim 61, wherein the musical characteristic is selected from the group consisting of tempo, melody, key, style, beat, syncopation, note, mode, scale, volume, chord, pitch, voice type and instrument type.

63. The gaming device of claim 60, wherein the success level includes a success level selected from the group consisting of no award, an award of zero, a balance of value accumulated by the player and an award of any magnitude.

64. The gaming device of claim 60, wherein the game is operable upon a wager so as to have a plurality of different success levels reachable by a player during a plurality of plays of the game.

65. A gaming device having a game operable upon a wager so as to have a plurality of different game events during at least one play of the game, the gaming device operable by a processor, the gaming device comprising:

at least one sound generating device operable to simultaneously produce a background sound and a primary sound during the play of the game;

information associated with a plurality of different designated characteristics of a plurality of game events;

at least one instruction which directs the processor to:

(a) track at least one characteristic of at least one of the game events during the play of the game; and (b) cause the background sound to be modified based on whether the tracked characteristic of the game event matches one of the designated characteristics.

66. The gaming device of claim 65, which includes information that relates the designated characteristics to a plurality of different musical characteristics, the processor causing the background music to have at least one of the musical characteristics based on whether the tracked characteristic matches the designated characteristic which is related to said at least one musical characteristic.

67. The gaming device of claim 66, wherein each one of the musical characteristics is selected from the group consisting of tempo, melody, key, style, beat, syncopation, note, mode, scale, volume, chord, pitch, voice type and instrument type.

68. The gaming device of claim 65, wherein the game events include an event selected from the group consisting of the player's pace of making game inputs, the player's tempo of making game inputs, a quantity of game inputs made by the player per unit time, a pace of game outcomes provided to the player, a tempo of game outcomes provided to the player, a quantity of game outcomes provided to the player per unit time, a quantity of wins provided to the player per unit time, a quantity of losses provided to the player per unit time, a success level reached by the player, a balance of value accumulated by the player and an award level reached by the player.

* * * * *